United States Patent [19]

Richier

[11] Patent Number: 5,044,969

[45] Date of Patent: Sep. 3, 1991

[54] FEMALE TERMINAL FOR DISTRIBUTION OF ELECTRICAL CURRENT AND PROVIDED WITH ELECTROCUTION-PREVENTING MEANS

[76] Inventor: Paul Richier, les Amandiers No.10, Néoules 83136, France

[21] Appl. No.: 491,740

[22] Filed: Mar. 12, 1990

[30] Foreign Application Priority Data

Aug. 25, 1989 [FR] France ..... 89 07132

[51] Int. Cl.[5] ..... H01R 29/00

[52] U.S. Cl. ..... 439/188; 200/51.09

[58] Field of Search ..... 200/51.09, 51.1, 51.11, 200/51.12; 439/181, 188, 338, 339

[56] References Cited

U.S. PATENT DOCUMENTS

| | | | |
|---|---|---|---|
| 2,540,496 | 2/1951 | Sperrazza | 200/51.09 |
| 4,283,102 | 8/1981 | Richier | 439/188 |
| 4,758,696 | 7/1988 | Grazer | 200/51.09 |
| 4,932,886 | 6/1990 | Glaser | 439/188 X |

FOREIGN PATENT DOCUMENTS

| | | |
|---|---|---|
| 0898738 | 1/1984 | Belgium . |
| 2518831 | 6/1983 | France . |
| 0278384 | 1/1952 | Switzerland . |

*Primary Examiner*—Neil Abrams
*Assistant Examiner*—Khiem Nguyen
*Attorney, Agent, or Firm*—Pierre Lesperance

[57] ABSTRACT

The terminal comprises a casing with an anterior mounting plate having two through-bores; a contact support facing the anterior wall having on the one hand two primary contacts having two primary contact surfaces connected to a secondary contact surface, and on the other hand two secondary contacts having a secondary contact surface, assembled to register with a secondary surface of the primary contacts, and a terminal; an insulating connecting blade comprising two pins contacting said secondary contact surfaces, when the blade is in a working position, a cavity enabling the passage of the primary contact surfaces, the latter together with the cavities being radially exteriorly oriented, an abutment area comprising, in register with a through-bore a radially exteriorly inclined surface; a spring outwardly biasing said blade from its working position until a male plug is connected.

8 Claims, 15 Drawing Sheets

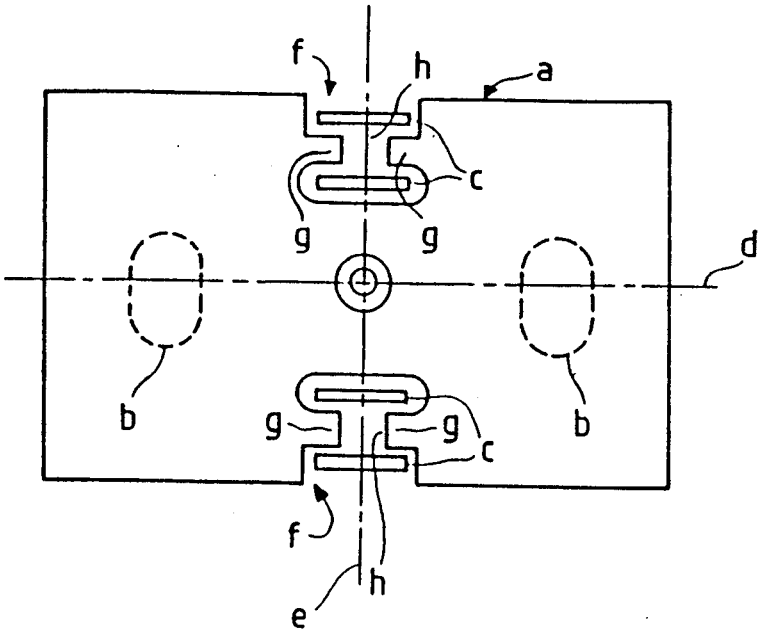
FIG. 11
FIG. 3
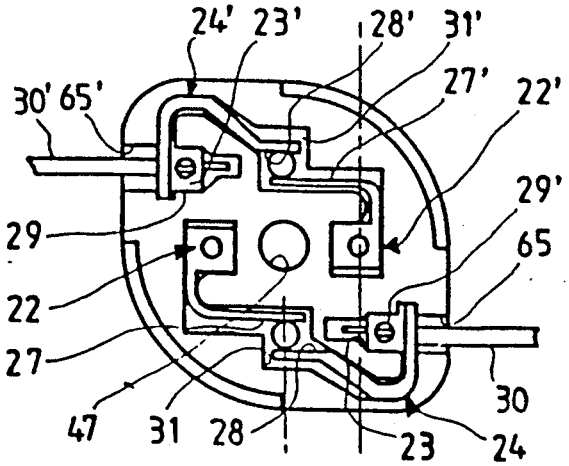

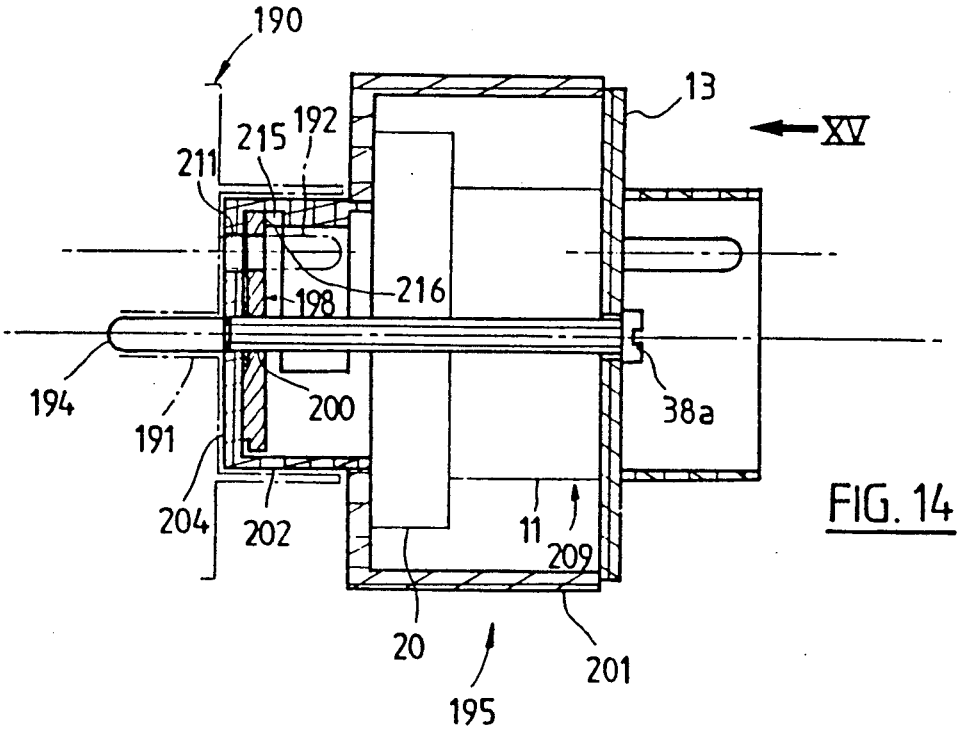
FIG. 14
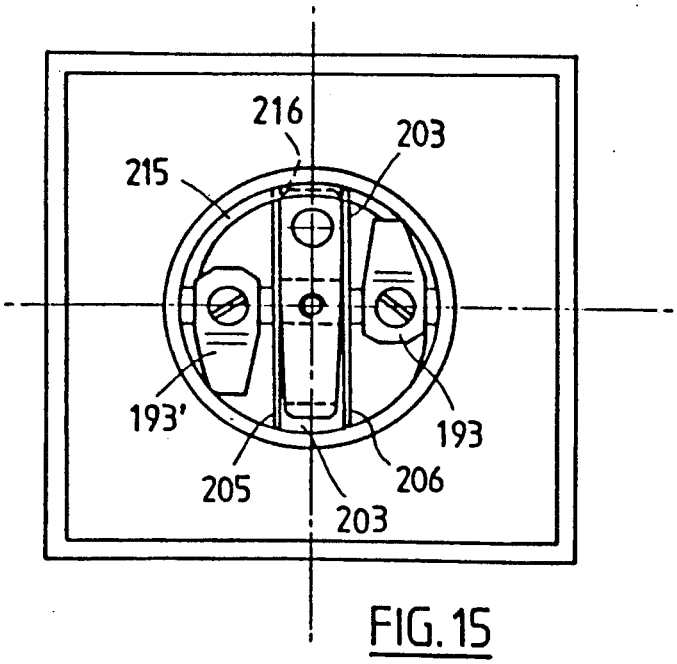
FIG. 15
FIG. 16
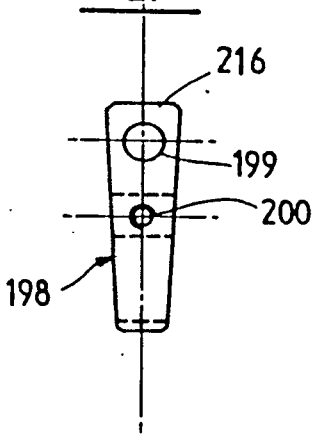

FIG. 18
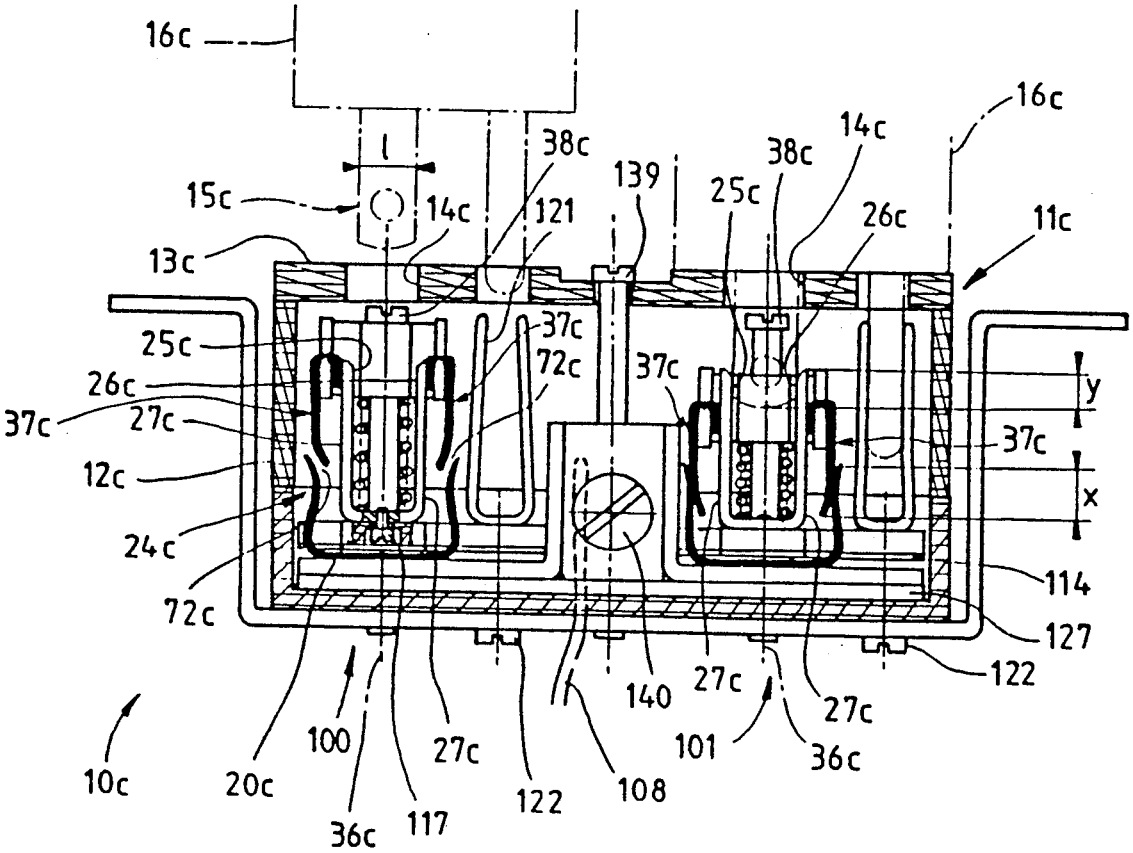
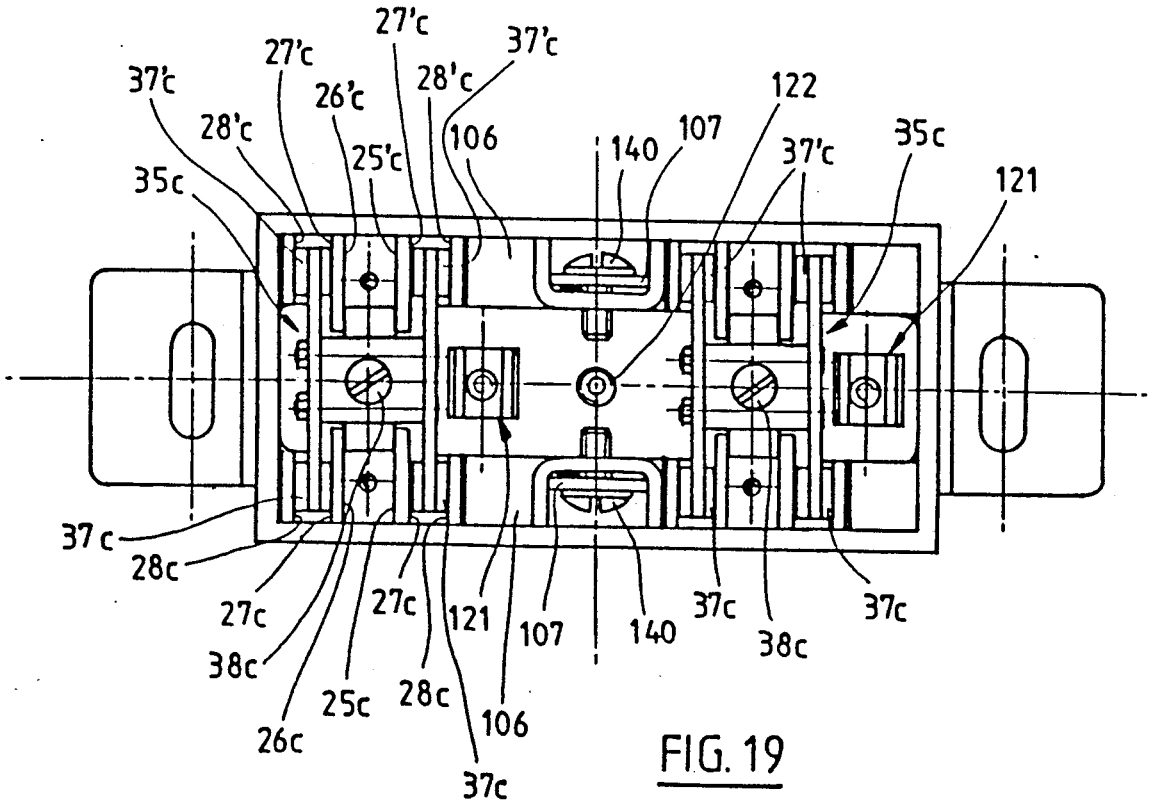
FIG. 19

FIG. 23
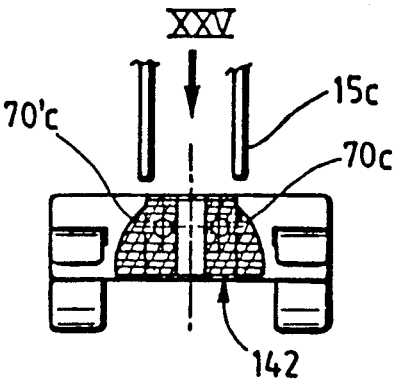
FIG. 24
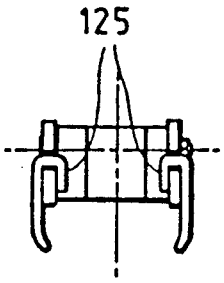
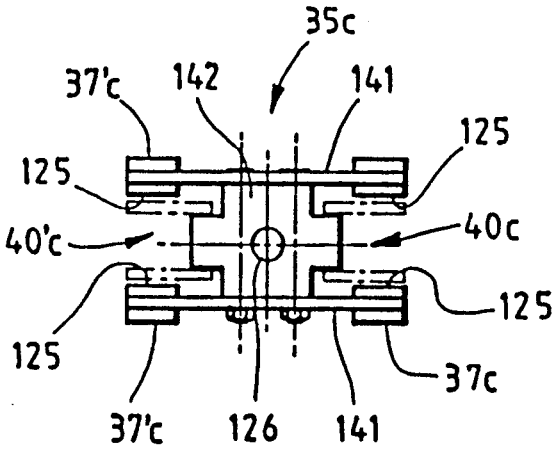
FIG. 25

FEMALE TERMINAL FOR DISTRIBUTION OF ELECTRICAL CURRENT AND PROVIDED WITH ELECTROCUTION-PREVENTING MEANS

BACKGROUND OF THE INVENTION

The invention relates to a female terminal for electrical current distribution, being provided with electrocution preventing means.

Such a terminal may exist in the shape of a wall plug, of an adaptor for wall plug, of an extension, or of any electrical current distribution device comprising, broadly stated, at least one assembly of at least two female sockets destined to receive as many male parallel pins belonging to an electrical male plug having a predetermined spacing.

In its (published) French patent application No 77 39232, in its (published) certificates of addition based thereon No 78 16340 and 78 34279, and also in its (published) French patent application No 81 01011, the applicant has already described an electrocution preventing electric current plug.

The present invention is broadly directed to an improvement of these devices, and more particularly, to the one described in the last mentioned French patent application.

The female terminal for electrical current distribution as described in the last mentioned French patent application comprises, broadly stated, at least one assembly of at least two female sockets destined to receive as many male parallel pins belonging to a male electrical plug having a predefined spacing, said female sockets extending parallel to a main axis, the terminal further comprising:

a casing made from an insulating material having an anterior mounting plate having at least two through-bores for the male pins;

a contact support facing the anterior wall, destined to support:

at least two primary contacts destined to receive said male pins, each of these primary contacts comprising to that effect two primary contact surfaces assembled in register with each other, extending in the pathway of the male pin so as to tightingly enclose the latter, these surfaces being connected to a first secondary contact surface;

at least two secondary contacts each having, on the one hand, at least one second contact surface and, on the other hand, electrical connecting means at a current outlet, each second secondary contact surface being assembled to be in register with one of said first secondary surfaces of primary contacts and to thus define an assembly of secondary contact surfaces;

an insulating connecting blade positioned between the casing anterior wall and the contact support, adapted to move along said axis while remaining parallel to itself, this blade having at least two connecting members adapted each to come in simultaneous contact with the two contact surfaces of an assembly of secondary contact surfaces when the blade is in a "working" position, the blade further comprising, in register with the primary contact surfaces of each of the primary contacts, a cavity destined to enable the passage of said primary contact surfaces of the whole of the primary contacts which come in register with the cavity and at least two abutment areas mounted partially in register with said through-bores;

elastic means adapted to maintain the blade spaced from its working position until an assembly of male pins are engaged into said sockets.

Such an electrical current distribution terminal is provided with an electrocution-preventing safety means. Indeed, it is not until the male plug is engaged into the terminal female sockets that the male pins, abutting against the abutment areas through-passages, will apply a compressive force against this connecting blade which will become pushed back, against the spring acting as an elastic means in its working position such that said connecting members supported by said blade will come, each, in simultaneous contact with an assembly of secondary contacts mounted into the contact support, thus enabling the passage of electrical current. On the other hand, when other objects, such as nails, are introduced into the sockets, they will abut against the primary contacts and, until a major force in a predetermined direction is applied against the abutment areas, the connecting blade will remain spaced from its working position: the contact will not be established between the secondary contacts assemblies, such that the current will not get through.

It can be understood why such electrical current distribution female terminals are so important, particularly when they are in the shape of wall plugs that can be easily reached by children that would be tempted to engage therein metallic objects.

The present invention is directed to an improvement of the terminal whose structure is above-mentioned.

Indeed, normally, the connecting blade is pushed back from its working position only when a predetermined force in a predetermined direction (normally parallel to the socket axis) is applied onto the abutment areas of the blade. Such a force is normally applied in the suitable direction when there is introduced a male plug in the female terminal. However, the inventor has discovered that in certain occurrences, particularly when there is introduced a cylindrical metallic object whose external diameter approximates the diameter of the plug male pins, the connector blade could be pushed back in its working position, at least on one of its sides, thus establishing an undesirable contact.

Following his research the applicant has noticed that the fact of being able of thus pushing again the connecting blade in its working position was caused by the fact that the above-noted metallic object was in fact sometimes guided if you will towards an abutment area, by the primary contact surfaces, whereas when there was introduced in the subject socket a metallic object of a diameter slightly smaller, the latter was not naturally guided toward the abutment area and that hence, it was required that a voluntary action be applied to push back the connecting blade.

The present invention is directed to an improvement of the above-noted structure thanks to which there may be introduced into female sockets metallic cylindrical objects whose diameter substantially corresponds to that of a male pin, without triggering the connecting blade, and the latter cannot be pushed back toward its working position until there is introduced in the sockets, simultaneously, two cylindrical pins extending parallel to each other and having the required spacing, i.e. a male plug.

The present invention overcomes this technical problem by proposing a female terminal having, generally speaking, a structure similar to the above-captioned one, and characterized in that the blade cavities are radially exteriorly oriented, as well as the primary contact surfaces, whereas each abutment areas comprises, in register with the associated through-bore, a radially exteriorly inclined surface.

Thanks to these devices, when an object is introduced into the through-bore, even if this object is a cylindrical object having a diameter identical to that of the male pins, the latter will scrape against the abutment area and will radially exteriorly slide, in such a way that it cannot bring the connecting blade toward its working position.

To bring the blade toward its working position, there must absolutely be simultaneously introduced pins extending along parallel directions and having the required spread or spacing: the safety of the device is in this fashion considerably increased.

SUMMARY OF THE INVENTION

Accordingly, there is disclosed, in accordance with the teachings of the invention, a female terminal for electrical current distribution, comprising at least one assembly of at least two female sockets destined to receive as many male parallel pins belonging to a male electrical plug having a predetermined spacing, said female sockets extending parallel to a main axis, the terminal further comprising: (a) a casing made from an insulating material comprising an anterior mounting plate having at least two through-bores for the male pins; (b) a contact support facing the anterior wall, adapted to carry: (i) at least two primary contacts destined to receive said male pins, each of these primary contacts comprising in view thereof two primary contact surfaces mounted in respective register, extending along the pathway of the male pin so as to tightingly enclose the latter, these surfaces being connected to a first secondary contact surface; (ii) at least two secondary contacts, each having, on the one hand, at least a second secondary contact surface and, on the other hand, electrical connecting means at a current outlet, each second secondary contact surface being assembly to be in register with one of said first secondary surfaces of primary contacts and to thus define an assembly of secondary contact surfaces; (c) an insulating connecting blade, positioned between the cavity anterior wall and the contact support, destined to move along said axis while remaining parallel to itself, this blade comprising at least two connecting members each destined to come in simultaneous contact with the two contact surfaces of assembly of secondary surfaces when the blade is in a "working" position, the blade further comprising, in register with the primary contact surfaces of each of the primary contacts, a cavity destined to enable the passage of said primary contact surfaces of the assembly of primary contacts which are in register with the cavity and at least two abutment areas mounted partially in register with said through-bores; (d) elastic means adapted to maintain said blade spaced from its working position until an assembly of male pins is engaged into said sockets; wherein said blade cavities are radially exteriorly oriented, as well as the primary contact surfaces, whereas each abutment areas comprise, in register with the associated through-bore, a radially-exteriorly inclined surface.

Preferably, said connecting blade comprises at least two axial guiding surfaces adjacent to said inclined surfaces and frontwardly thereof.

Advantageously, the connecting blade further comprises, frontwardly of the guiding surfaces, at least two second inclined surfaces. It is envisioned that said first inclined surface be preferably arcuate. Profitably, staple means are provided, to fixedly secure the terminal to a wall plug.

Preferably, the terminal is destined to be connected to a terminal, particularly a wall pug, comprising a projecting grounding pin, and wherein it comprises securing means adapted to generate a major frictional force onto the grounding pin. In such a latter case, said frictional means could then comprise a wedge lever having a through-bore for the grounding pin and means adapted to enable the tilt of the lever in such a way that the grounding pin will become stuck into the through-bore for this pin contained by the wedge lever.

Advantageously, said contact surfaces and said connecting members are respectively conformed in such a way that when said male plug is disconnected, said male pins are disengaged from the primary contact surfaces before said connecting members are disengaged from the assembly of secondary contact surfaces.

BRIEF DESCRIPTION OF THE DRAWINGS

FIG. 3 is a rearward view of a terminal contact support member shown in FIGS. 1–2, the various contacts being illustrated installed onto this member;

FIG. 11 is a view showing in elevation a prior art connecting blade;

FIG. 14 is an axial section of another embodiment of adaptor comprising the terminal illustrated in FIGS. 1–2;

FIG. 15 is an internal view of the casing of the adaptor of FIG. 14 according to arrow XV;

FIG. 16 is a detailed view of a wedge lever used into the adaptor illustrated in FIG. 14;

FIG. 18 is an axial section of the assembly of FIG. 17;

FIG. 19 is a top plan view along arrow XIX of FIG. 18 of the assembly of terminals as illustrated therein, an anterior wall of this assembly having been removed;

FIG. 23 is a sectional view along line XXIII—XXIII of FIG. 26 of a connecting blade used in the terminals shown in FIGS. 17-20;

FIG. 24 is a sectional view along line XXIV—XXIV of FIG. 23;

FIG. 25 is a top plan view along arrow XXV of FIG. 23;

DETAILED DESCRIPTION OF THE INVENTION

Figure 1:
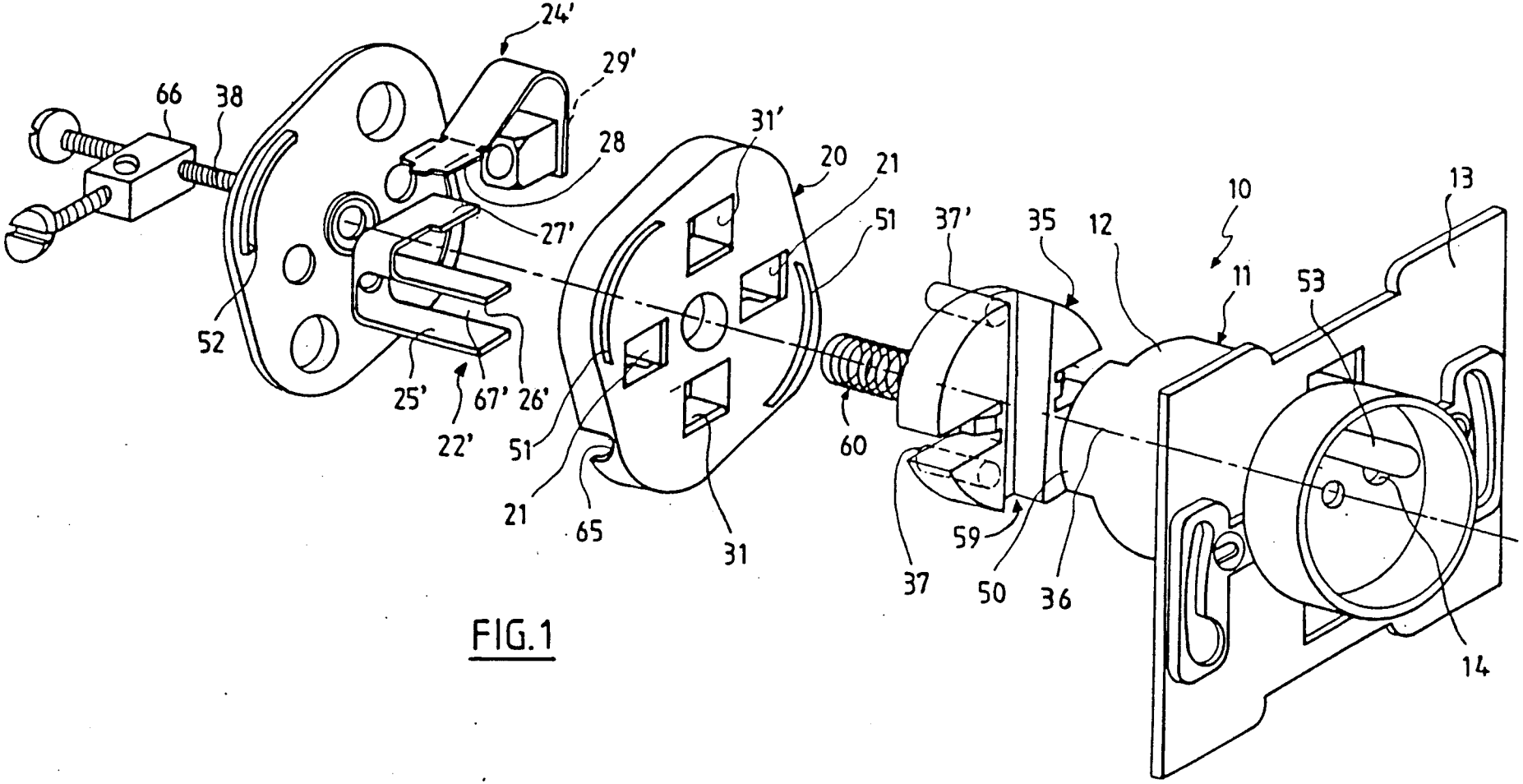
FIG. 1 is an exploded perspective frontward view of a preferred embodiment of electrical current distribution terminal in accordance with the invention.
Figure 2:
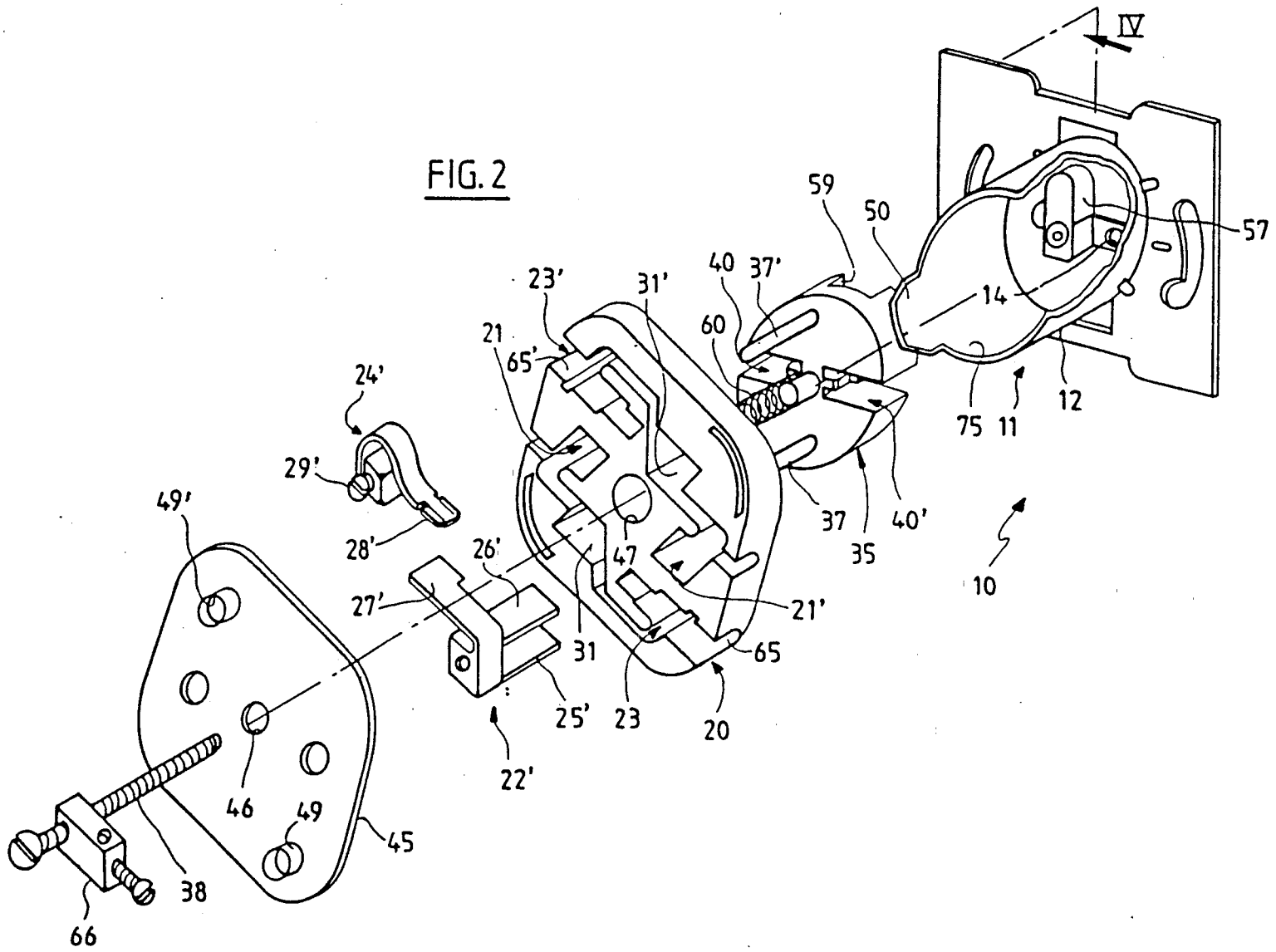
FIG. 2 is an exploded perspective rearward view of the electrical current distribution terminal of FIG. 1.

In accordance with the chosen embodiment of the invention shown in FIGS. 1-2, terminal 10 comprises a casing 11 having a cylindrical body 12 and an anterior wall 13 comprising through-bores 14, 14' for the male pins 15, 15' of a male plug 16. The body 11 is carried by an anterior mounting plate 13 destined to enable the terminal 10 to be secured to a wall. It is understood that this terminal 10 appears in fact as a wall plug comprising a grounding pin 18, dimensioned to fit the French standard at the above-noted French patent application filling date. However, as will become apparent hereinafter, the invention could also have been illustrated applied to another type of plug, including foreign standards and in particular the Canadian and United States of America electrical standard, or to that effect any other type of electrical distribution terminal, e.g. an extension, or an adaptor as illustrated in FIGS. 12 to 16.

Terminal 10 comprises a contact support 20 facing the anterior plate 13 having first casings 21, 21' destined to receive each a primary contact 22, 22' et second casings 23, 23' destined to receive each a secondary contact 24, 24'. On FIGS. 1-2, which are exploded views, only one of the primary contacts 22, 22' and one of the secondary contacts 24, 24' have been shown.

Each primary contact 22 (22') comprises two primary contact surfaces 25, 26 (25', 26'), assembly in register to each other, and as will become apparent hereinafter, assembled to extend along the pathway of the male pins 15, (15'), to constitute a primary contact space 67 (67') and to tightingly enclose the male pin within that space. The primary contact surfaces 25, 26 (25', 26') are connected to a first secondary contact surface 27 (27'). It will be understood that, in this embodiment of the invention, the secondary surface of contact 27 (27') extend along a plane generally parallel to that of the primary contact surfaces, but in a direction making roughly a 90° angle with that one in which extend the primary surfaces of primary contact.

Each secondary contact 24, 24' includes on the one hand, a second secondary contact surface 28 (28'), and on the other hand electrical connecting means (here in register) 29 (29') enabling to connect each of these secondary contacts with a current outlet schematized, in FIG. 3, by conductive wires 30, 30'.

It is shown in FIGS. 2-3 that the cavities 23, 23' have a shape complementary to that of contacts 24, 24'.

The casings of the primary and secondary contacts 21, 23 and 21', 23', respectively, are connected in pairs and thus merge into the openings of secondary contact 31, 31' extending through the contact support 20, the different contacts and cavities hereinabove-described are conformed in such a way that each first secondary contact surface 27, (27') is respectively positioned interiorly of said secondary contact surfaces 31, 31', in register with each other and parallel to a second secondary contact surface 28, (28'); assemblies of secondary contacts 27, 28 and 27', 28' respectively, are thus housed into said secondary contact openings 31, 31' and thus determine secondary contact spaces 72, 72'.

The female terminal for electrical current distribution 10 further comprises an insulated connecting blade 35, positioned in between the anterior wall 13 of the casing 11 and the contact support 20. This connecting blade est movable and may be displaced along a main axis, (here the main axis of symmetry 36 of the assembly) while remaining parallel to itself. The blade 35 has a substantially cylindrical exterior shape, of a diameter substantially smaller than the internal diameter of the cylindrical body 12 of the casing 11.

The connecting blade 35 comprises two connecting members which, in this embodiment, are constituted by secondary pins numerals 37, 37', on the drawings. There is shown that the pins 37, 37' are respectively assembled to be in register each with a secondary contact space 72, 72'. In view thereof, it is understood that the contacts 27, 28 (27', 28') are spaced by a distance substantially smaller than the thickness of the pins 37, 37'.

With respect to the primary contact surfaces belonging to the primary contacts 22, 22', the blade 35 comprises two cavities 40, 40' through which the primary contact surfaces 25, 26 and 25', 26' respectively will extend. These cavities 40, 40' for the passage of the primary contacts are positioned in register with the through-bores 14, 14' of male pins of the plug. In view thereof, the connecting blade 35 comprises means enabling to maintain same in such a position that the passage cavities 40, 40' will always remain in register with the passage holes 14, 14'. In this embodiment, these means consist of a radial guiding ridge 57 carried by the anterior wall 13, cooperating with a complementary ridge 59 provided to the front of the connecting blade.

In the chosen embodiment as illustrated, there is further provided a rear mounting plate 45. This plate is particularly destined to enable the insulation of various contacts carried by the contact support member 20. As explained hereinabove, there is provided a central mounting screw 38 and in view thereof, the rear plate 45 is provided with an axial bore 46. An axial bore 48 suitable for enabling through passage of the central mounting screw 38 is also provided centrally of the blade 35. Also, an axial bore 37 if relatively large diameter is provided in the contact support member 20.

The rear mounting plate also comprises two other bores 49, 49' positioned in register with screws 29, 29' of secondary contacts 24, 24'. In view of the mounting the body 12 of the casing 11 is provided with two peripheral catches 50. These catches or stop-pins are conformed to become embedded with peripheral passages 51 provided onto the contact support member 20. Mounting ridges 52 are provided onto the front of the rear mounting plate 45, in register with the peripheral passages 51 as illustrated in FIG. 1.

Figure 4:
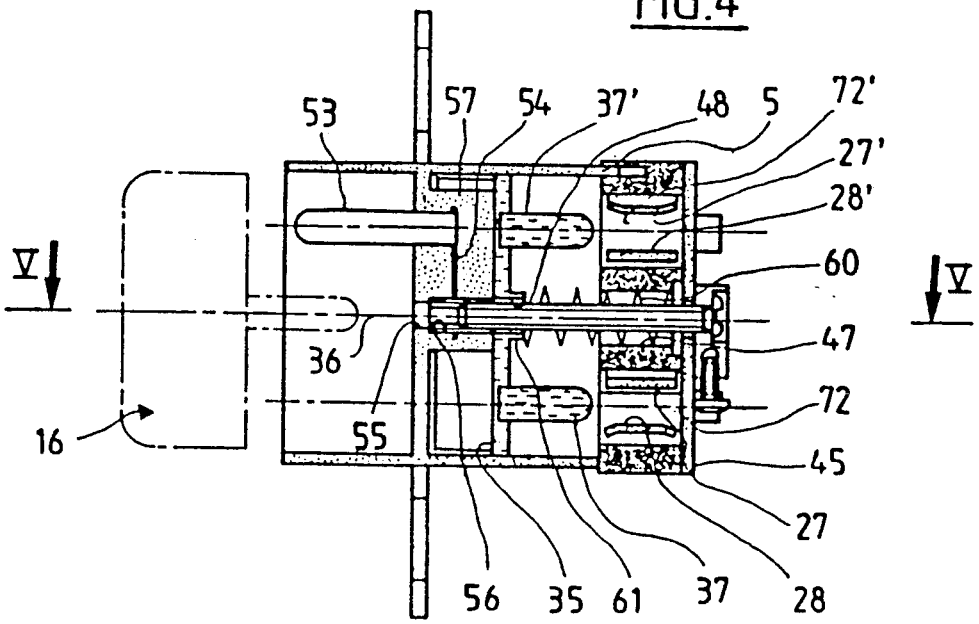
FIG. 4 is a sectional view along cutting plane IV shown in FIG. 2, of the assembled terminal.
Figure 5:
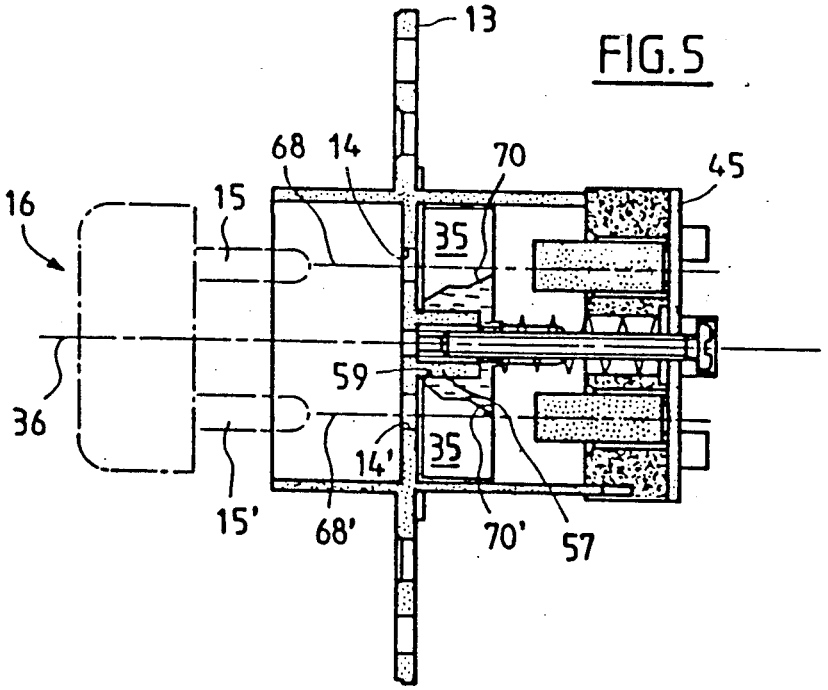
FIG. 5 is an axial sectional view following the line V—V of FIG. 4.

The schematic sections of FIGS. 4–5 show the mounting of a female terminal that will now be detailed. The guiding for the mounting of a grounding pin 53 bound to a metallic contact plate 54. The metallic contact plate 54 radially extends between the pin 53 and an insert 56 positioned into an axial bore 55. The insert 56, the pin 53 and the plate 54 are integrated into the ridge 57 during the molding of the latter.

The insert 56 is metallic and comprises an axial threaded bore into which the mounting screw 38 is to be screwed.

The terminal also comprises elastic means, herein illustrated as a spring 60 destined to abut against the connecting blade 35, on the one hand, and onto the rear mounting plate 45 on the other hand. In view thereof, the blade 35 comprises a catch 61 for centering the spring 30. It is understood that the axial bore 47 of the contact support 20 has a sufficient diameter to enable the passage of the spring 60 in such a way that the latter may abut against the rear plate 45.

Figure 8:
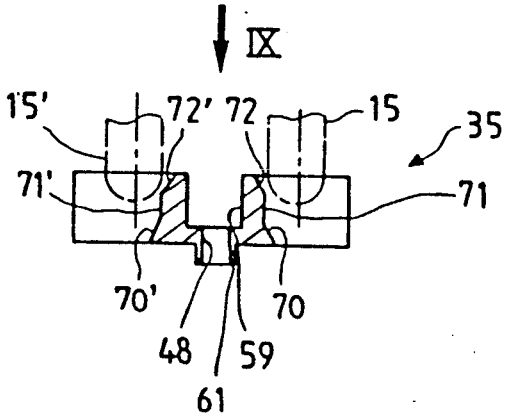
FIG. 8 is diametral sectional view taken along line VIII—VIII of FIG. 9, of a terminal connector blade.
Figure 9:
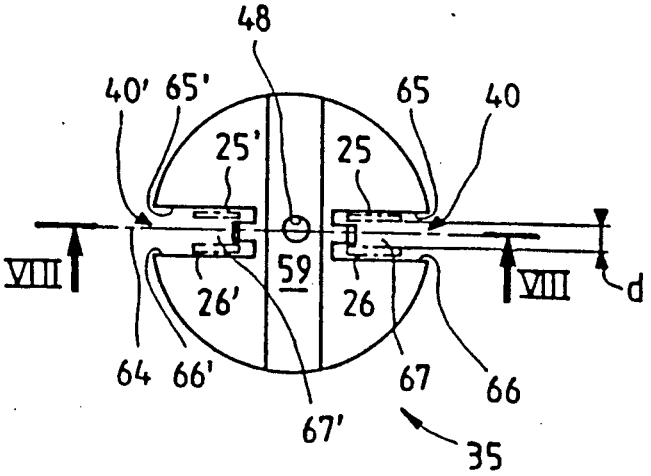
FIG. 9 is a front elevational view along the arrow IX of FIG. 8 of the connecting blade.

There will now be detailed in FIGS. 8–9 two of the major features of the present invention.

On FIG. 9, which is a front face view of the connecting blade, there is clearly shown the shape of the cavities 40, 40' of the primary contact surfaces passages, 25, 26, and 25', 26' respectively. These contact surfaces have in fact been shown in phantom lines.

According to a feature of the invention, the cavities are radially exteriorly oriented, as with the primary contact surfaces 25, 26 and 25', 26' respectively.

Indeed, the primary contact surfaces are here planar and, in accordance with the invention, there are generally oriented toward a radial direction, here parallel to a diametral symmetrical axis bearing numeral 64 in FIG. 9 and defining the sectional line VIII—VIII. The cavities 40 have a roughly rectangular shape and comprise each two guide surfaces of radial orientation associated with the primary contact surfaces in question. On FIG. 9, the guide surfaces bear numerals 65 and 66 (they are respectively associated with the primary contact surfaces 25, 26), 65' 66' (they are associated with the primary contact surfaces 25', 26').

There is further shown on this figure that the contact surfaces 25, 26 (25', 26') are parallel to each other and spaced by a distance d of magnitude substantially smaller than the thickness of the pins 15, 15' of the male plug 16 destined to be introduced into the female terminal.

In this embodiment, the openings 40, 40' are advantageously exteriorly open.

The connecting blade 35 further comprises an abutment area 70 (70') partially positioned in register with the through-bores 14, 14', see FIG. 5.

In accordance with a feature of the invention, each abutment area comprises, in register with the passage with which it is associated, a radially exteriorly inclined surface.

In the chosen embodiment as illustrated, the radially exteriorly inclined surface 70 (70') occupies the whole of the abutment area positioned in register with the through-bores 14, 14'.

It is to be understood that the meaning of "radially exteriorly inclined surface" is that when one follows said surface 70 or 70' from front to rear, i.e. in the sinking direction of the male plug 16 into the female terminal 10, the surface tends to spread apart from the symmetrical axis 36 where, in other words, when one follows the inclined surfaces 70, 70', the more one gets near from the anterior plate 13, the more one gets near the central axis of symmetry 36.

In the embodiment now described, the abutment surfaces 70, 70' are adjacent to guiding surfaces 71, 71' of the pins 15, 15'. Hence, surfaces 71, 71' define a general orientation parallel to the axis 36 and their relative spacing correspond substantially to that of the pins 15, 15' or, more broadly speaking, to the spacing between the male pins of the male plug destined to be introduced into the female terminal.

FIG. 8 shows clearly these features. Indeed, on this figure, there is illustrated in full lines and in diametral section the connecting blade 35 together with, shown in dotted lines, the pins 15, 15' in a position which they occupy during the engagement of the plug 16 into the terminal 10, just before the engagement of these pins with the above-described connecting blade members.

On FIGS. 5 and 8, there is shown that, at the front of the guiding surfaces 71, 71', these latter are adjacent to the second inclined surfaces 72, 72'.

Operation of the above-described terminal will now be detailed.

Generally speaking, it will be understood that the through-bores 14, 14', the cavities 40, 40' (when the connecting blade 35 is applied against the posterior face of the anterior wall 13) and the connection spaces 67, 67', provided between the pair of primary contact surfaces, constitute female sockets able to receive the male pins 15, 15' of the pug 16. Indeed, each bore 14 comes in register with a cavity 40 (40') and with a primary connection space 67 (67'), as schematized in FIG. 5 by the axis 68, 68'.

Moreover, it is to be noted that the whole of the parts, except the male pin 53 and the ridge 57, are assembled in such a way that their symmetrical axis coincide with the symmetrical axis 36 of the terminal.

The conductors 30, 30' may be installed into the contacts 24, 24' by having these conductors 30, 30' extend into a lateral mounting passage 65, 65' which communicate with the casings 23, 23'. They may be made integral with the contacts 24, 24' by screws 29, 29' which can be reached from apertures 49, 49' made into the rear mounting plate 45. The ground wire is electrically connected to the central mounting screw 38 through a screw connecting terminal 66. The ground wire is thus connected to the grounding pin 53 through the screw 38, through the metallic mounting insert 56 and through the plate 54.

The above-described terminal provides a good electrocution preventing safety for the following reasons that will be detailed with reference to FIGS. 4–7.

Figure 6:
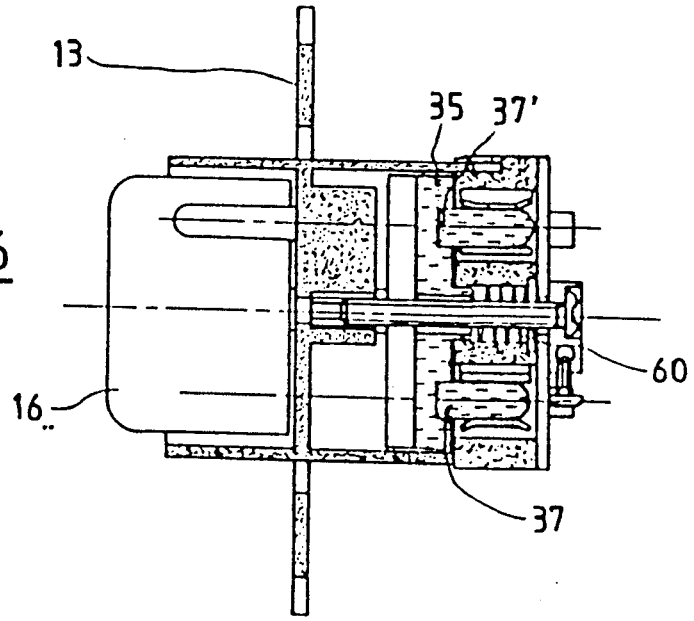
FIGS. 6 and 7 correspond to FIGS. 4–5 and show the terminal when a male plug is connected thereto.
Figure 7:
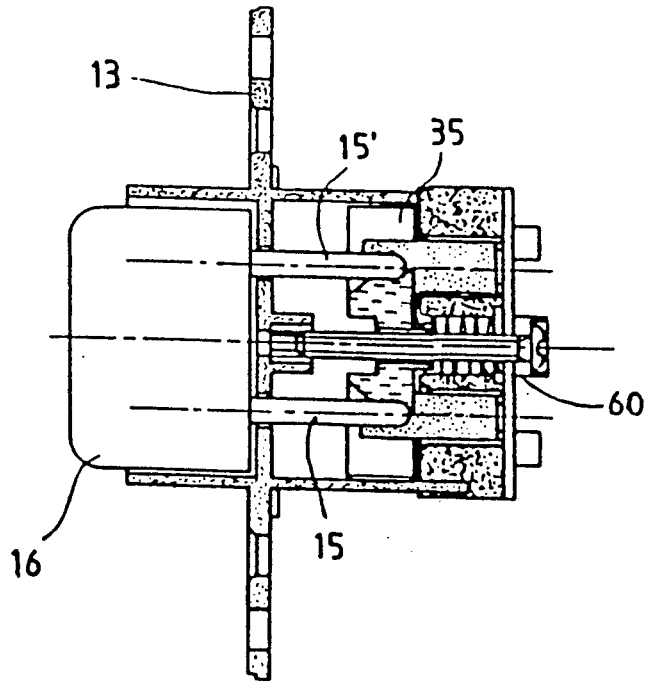

The two axial sections illustrated in FIGS. 5 and 5 illustrate the terminal 10 and the male plug 16 before connection, whereas FIGS. 6–7 show these members after connection.

Before introduction (FIGS. 4–5), the insulating connecting blade 35 is applied against the rear face of the ridge 57 by the spring 60 which abuts against the rear mounting plate 45. As explained hereinabove, the pins 37, 37' carries by the connecting blade 35 are in register each with a secondary contact space 72 (72') constituted by an assembly of contacts 27, 28 (27', 28').

Without a male plug, it is possible to introduce in these bores 14, 14' metallic objects. Bearing such a hypothesis in mind, these metallic objects (e.g. nails) extend through the holes 14 and engage into the primary contact surface situated between the primary contact surfaces 25, 26 (or 25', 26' as the case may be). The connecting blade is not pushed back against the bias of the spring 60 and the pins 37, 37' do not come in contact with the secondary contacts 27, 28 and 27', 28' respectively: the electrical current cannot pass.

When the plug 16 and the pins 15, 15c' are engaged into the bores 14, 14' after a certain time, they meet with the primary contact surfaces 25, 26 and 25', 26' respectively. They then engage into the primary contact space 67, 67' provided respectively between the contacts 25, 26 and 25', 26'. From that time, electrical connection is established between the pins 15 (15') and the primary contact surfaces 25, 26 (25', 26'). However, there is shown that the connecting blade is not pushed back or, at least, that it is not slightly pushed back: the current still does not pass.

It is not until the male pins 15, 15' abut onto the abutment areas 70, 70' from the connecting blade 35 and which are disposed along its pathway (FIGS. 5 and 8) in the primary contact space provided between the primary contacts 25, 26 and 25', 26' respectively, that the connecting blade will be pushed back in a working position shown in FIGS. 6–7: each secondary pin 37 (37') thus establishes a contact between the secondary surfaces 27, 28 (27', 28') with which it is associated. The current now passes from the contact terminal 29 (29') to the second secondary contact surface 28 (28'), then to the pin 37 (37'), thereafter to the first secondary contact surface 27 (27'), then to the primary contact surfaces 25, 26 (25', 26'), and finally, to the selected male pin 15 (15').

The herein described terminal presents therefore, thanks to the invention, and particularly in view of the inclined abutment surfaces 70, 70' of the connecting blade 35, a much better electrocution-preventing safety than the plug described in said French patent application No 81 01011.

There is illustrated in FIG. 11 under alphabetical identification (a) a connecting blade similar to that described in said French patent application 81 01011. Under reference (b) there is schematically illustrated secondary connecting pins which were provided and under references (c) there was schematically illustrated the primary contact surfaces. In (d) and (e), there has been schematized two orthogonal symmetrical axiss of the assembly.

There is shown that the primary contact surfaces (c) have an orientation transverse to the radial direction, since they are perpendicular to axis (e).

Under references (f), the cavities for passage of the primary contact surfaces have been illustrated. As (g), there is illustrated four abutment legs disposed in pairs within the cavities (f).

Description of the prior art will stop here. It may however be useful for the reader to carry on perusal in the French patent 81 01011, particularly with respect to the description of the FIGS. 6 and 8.

When the pins of the male plug sinks, they abut onto the abutment legs (g) to entrain the connecting blade (a) toward its working position.

The device described and claimed in the above-referenced French patent disclose a good electrocution-preventing safety in that when one pushes a metallic object into the sockets, normally, this metallic object will extend through the spacing (h) separating the abutment legs (g), between the primary contact surfaces: the connecting blade will not be repelled and the current will not pass.

However, the inventor has discovered that it was relatively easy for a child to induce displacement of the connecting blade (a). In order to do this, there is only required to push a metallic object of sufficient thickness so that it will abut onto a pair of legs (g) as well as unlock the exterior elastic leg of the contacts, inducing the sinking of the connecting blade (a). This may be the case when, e.g., the metallic object has an exterior diameter corresponding substantially to that of the standard male pin. In fact, it is the more so easy in such a hypothesis to push back the connecting plate (a) if the child uses for this purpose a standard pin from a male plug, the end of this pin is rounded and will wedge between the abutment catches (g) which face each other, drawing therefore the connecting blade (a) toward its working position.

Such a result may also be obtained if the child engages a flat-headed nail which will also abut simultaneously onto the two facing abutment legs (g), and will unlock the contact leg, bring the connecting blade (a) towards its working position.

The present invention circumvents such an disadvantage.

Figure 10:
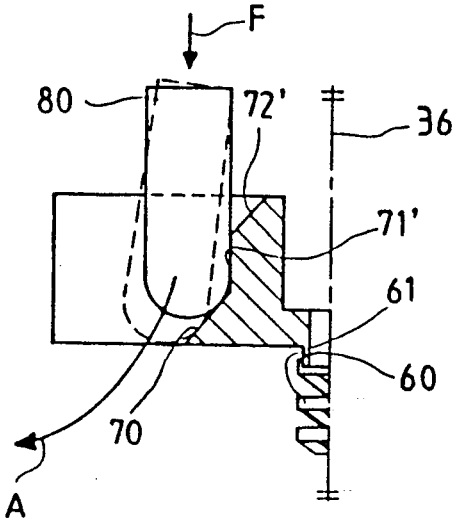
FIG. 10 is a detailed, partially diametral, sectional view of the connecting blade.

Indeed, there is schematically illustrated in FIG. 10 a partially diametral section of the connecting blade and a pin 80 which has been engaged into the opening facing the abutment surface shown in this figure.

It is understood that the pin 80, if it is not firmly maintained parallel to the axis 36, will scrape against the abutment surface 70 and will come to be radially exteriorly released in a natural way in the direction of arrow A, as illustrated in phantom lines. In order to bring the connecting blade against the spring 60, one has to apply a particularly important axial force (in the direction of arrow F) the more so if one takes into account the fact that by thus engaging a pin such as the pin 80 into the terminal, the plug on this pin is of low precision and usually improperly anchored; unless a voluntary and thoughtful action is followed and the required force F, applied, the pin 80 will scrape onto the inclined abutment surface 70.

In practice, it will not be when one engages into the bores 14, 14' of the pins 15, 15' belonging to a plug 16 and disclosing the required spacing that one is successful in displacing the connecting blade 35 toward its working position. Indeed, it will usually be only in this hypothesis that a person which engages a male connector will have on the latter a sufficient grip to apply the required force. Moreover, the connector discloses a rigid structure such that the pins 15, 15' keep their orientation parallel and thus will not scrape onto the abutment surfaces 70.

The guiding surfaces 71 enable the guiding of pins 15, 15' before the latter reach the abutment surfaces 70, 70'.

The surfaces 72, 72' which are also exteriorly inclined, will allow any metallic object to exteriorly scrape which would have been introduced obliquely through the bores 14, 14'.

FIGS. 6 and 7 further disclose another advantageous feature of the herein-described invention.

The applicant has indeed been confronted with the following technical problem. One takes into account an appliance connected to the electrical energy distribution network thanks to a male plug engaged into a female plug. If one disconnects the appliance, still under tension, by simply pulling out the male plug from the female plug, a spark is produced when the male pin engaged into the socket of the female plug connected to the phase is disengaged therefrom. Although it is known that such a procedure of disconnecting an electrical appliance is not recommended, such a spark entails usually of no consequence.

On the other hand, if one takes into account a female terminal for electrical current distribution, as the one now described, if the spark is produced between an assembly of secondary contact surfaces 27, 28 (or 27', 28') and the connecting member such as the secondary pin 37 (37'), the spark may have various consequences wearwise for the system.

The properties of the herein-disclosed invention permit to circumvent such a disadvantage.

In accordance with this feature of the invention, the shapes of the various contact surfaces and of those of the connecting members are such that during the male plug disconnection, the male pins are disengaged from the primary contact surfaces before the connecting members are disengaged from the secondary contact surfaces assemblies. Hence, the spark will be produced, should the occasion arise, between one of the male pins and the end of the primary contact surface hear the through-holes. Therefore, the probability of deterioration and particularly of the connecting blade locking is then strongly reduced.

In the embodiment now described, that which enable to use such a feature of the invention includes: the respective dimensions of the primary contact surfaces, of the secondary contact surfaces and of the secondary connecting pins. Indeed, it is known that, accordingly with the French standard, the male pins have a length of 18 mm. In the present embodiment, the length of the primary contact surfaces is such that the length of contact between each thereof and the male pins is not more than 6 mm when the male pin is plugged in (see FIG. 7); the length of the secondary contact pins 37, 37' is of 10 mm, the axial length of the contact between the pins 37 and the secondary surfaces 27, 28 (respectively 37', 27', 28') is also of 10 mm.

There thus follows that during the unplugging of the male plug 16, after a 6 mm displacement thereof toward the left of FIGS. 6–7, the male pins 15, 15' will become disengaged from the primary contacts while the secondary contact pins 37, 37' will remain engaged into the secondary contact assemblies: the spark will be produced at that time (if it ever is produced) between one of the pins 15,'15' and the primary contact surfaces still connected to the phase.

There is thus shown that, thanks to this disposition, the spark cannot be produced about the secondary contact pins 37, 37' and the secondary contact surfaces' assemblies.

There will now be described in FIGS. 12–13 an alternate embodiment of terminal which has just been described, this terminal being integral to a so-called "adaptor" device, i.e. a device enabling the connection of a terminal in accordance with the present invention to a wall plug or other not being provided with electrocution-preventing means.

It is indeed known that most of the wall plugs are not for the time being provided with electrocution-preventing means. It is thus desirable that such plugs be provided with electrocution-preventing means, and particularly those within reach of children. The present invention is therefore further directed to an adaptor which permit to install onto an existing wall plug an electrocution-preventing terminal, the adaptor comprising means destined to enable securing the terminal to a wall plug in such a way that this terminal cannot be pulled out, nor easily dismantled from the wall plug.

More specifically, the herein-disclosed invention is directed to such an adaptor for relatively planar female plugs installed onto a wall and not comprising any projecting grounding plug pin.

Figure 13:
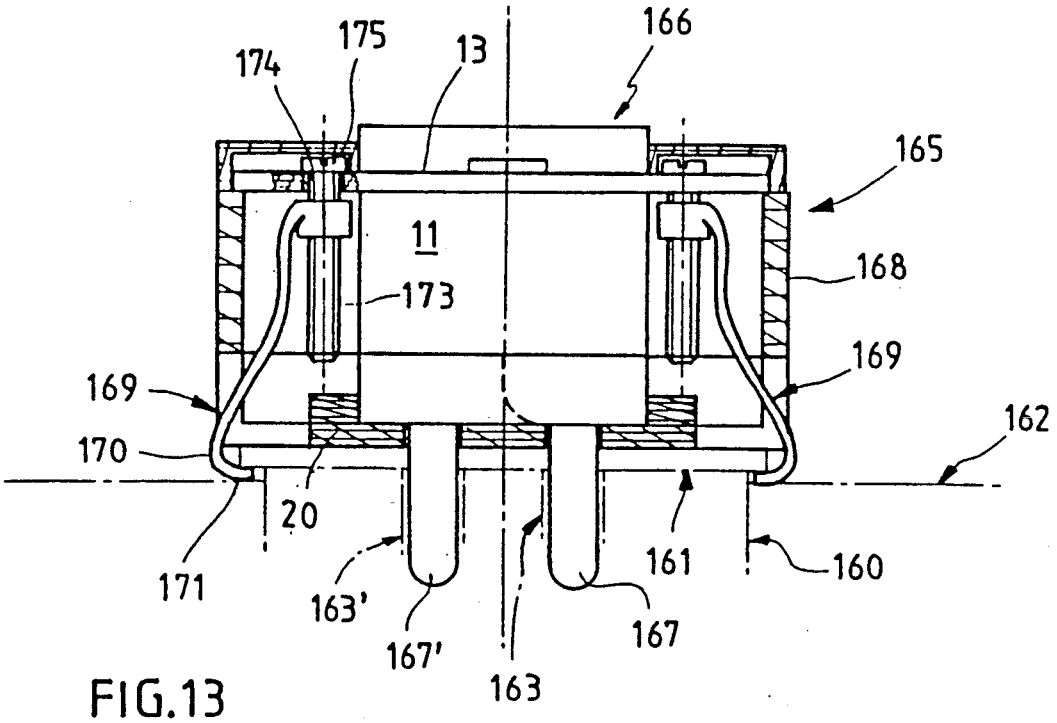
FIG. 13 is an axial section of the adaptor of FIG. 12.

Such a wall plug is schematized in phantom lines in FIG. 13 under numeral 160. It specifically comprises a plate 161 mounted to and slightly thicknesswisely projecting from a wall 162. The plug 160 comprises in a conventional fashion two female sockets 163, 163'. The illustrated assembly corresponds to the French standard effective at the time of the filing of the French patent application.

Figure 12:
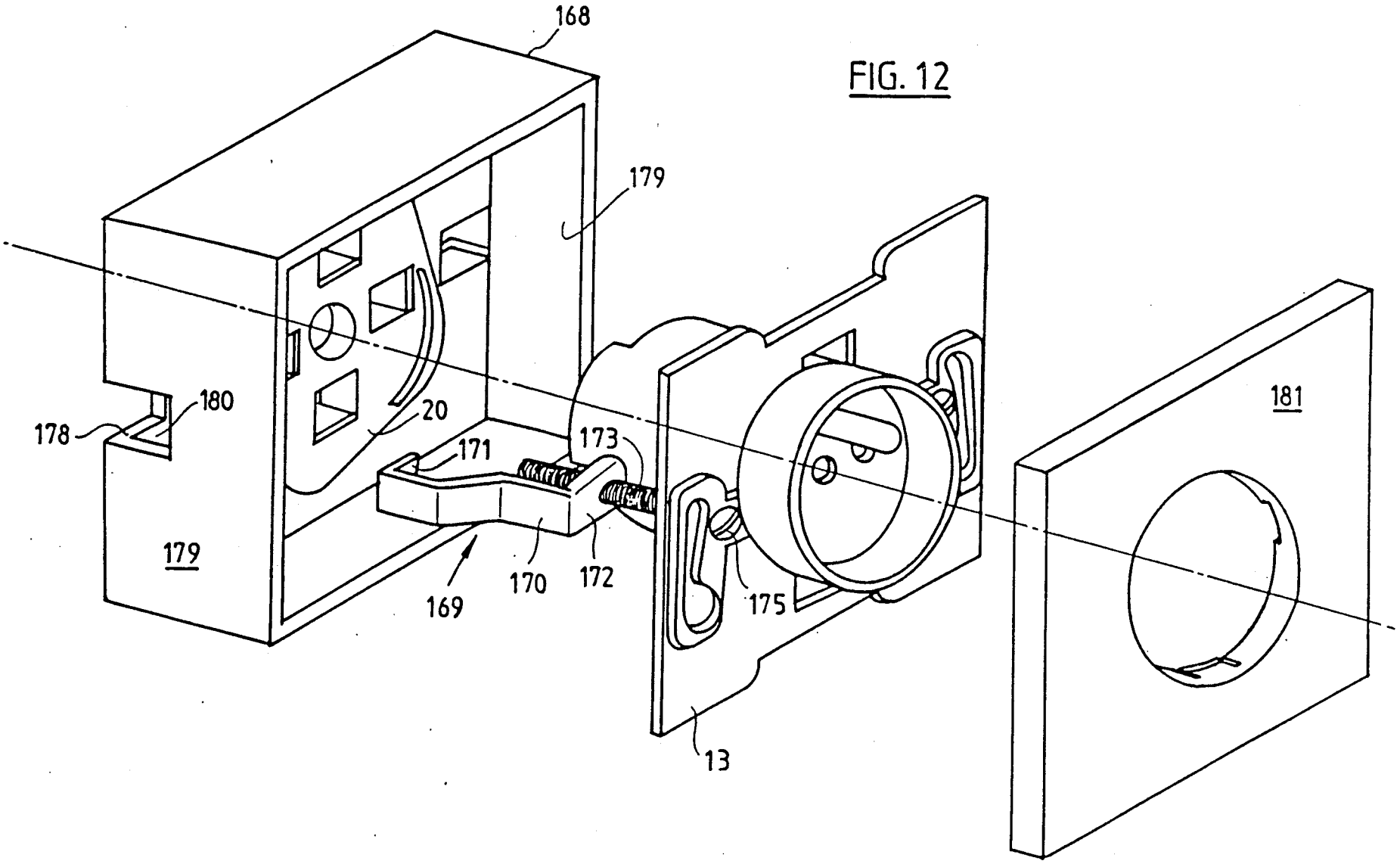
FIG. 12 is an exploded perspective, frontward view of an adaptor comprising an electrical current distribution terminal, similar to that one illustrated in FIGS. 1–2.

The adaptor illustrated in FIGS. 12–13 is generally identified by numeral 165. It essentially comprises a terminal 166 similar to that described in relation to FIGS. 1–11. On FIGS. 12–13, the only elements illustrated are the body 11, the anterior wall 13 and the contact support 20.

It is to be noted that the secondary terminal contacts are connected, by welding or any other means, to male contact pins 167, 167'. For the remainder of the structure, the terminal 166 is identical to that one hereinabove described.

Terminal 166 is housed into a casing 168 into which are mounted, in accordance with the teachings of the invention, staple means 169. These staple means essentially comprises a staple 170 made from a metallic part extending between a staple portion 171 and an adjustment portion 172 having a threaded bore. A screw 173 is mounted into the adjustment portion 172. This screw extends through a bore 174 made into the anterior plate 13, the screw head 175 carrying this anterior plate.

In the present embodiment, two assemblies of staple means 169 are provided, mounted on one and the other side of the body 11 of the terminal 166.

Each staple 170 extends through the casing 168 by a passage 178 provided onto the lateral faces 179 of the casing as well as onto the posterior wall 180 of the latter.

The assembly is assembled thanks to a mounting screw 38 (FIG. 4), not shown on FIGS. 12 and 13. There is also provided a concealing member 181 being engaged with a clip to the anterior mounting wall 13.

FIG. 13 illustrates the mounting of an adaptor 165 onto the plug 160. The pins 167, 167' of the adaptor are engaged into the female sockets 163, 163' of the plug 160. The staple means are then installed. For this purpose, the screw 173 is unscrewed in such a way that the staple end 171 be free. There is then introduced, in a substantially forcible fashion, this staple end 171 between the front plate 161 of the plug 160 and the wall 162. The screw 173 is then tightened as illustrated in FIG. 13.

In this way, there is thus obtained a particularly sturdy anchoring of the adaptor 165 to the wall plug 160 in such a way that it will be difficult to pull out the adaptor 165.

There is also shown that the front concealing member 171 is clipped to the anterior wall 13. Hence, to dismantle the adaptor, the concealing member 181 has first to be unclipped and then the screws 173 have to be unscrewed. It can be understood that the dismantling of the adaptor is not a simple operation which could be randomly effected by a child.

FIGS. 14–16 will now be described with respect to another embodiment of adaptor, destined to be connected to a wall plug comprising a projecting grounding pin.

On FIG. 14, which is an axial section of the adaptor, the wall plug is illustrated in phantom lines, bearing numeral 190, the female sockets of this plug being illustrated under numeral 191. This wall plug comprises a grounding plug 192 that is projecting therefrom. This plug meets the dimensional French standards at the time of filing of the French patent application.

The adaptor essentially comprises a terminal 209 provided with electrocution preventing means in accordance with those described in relation to FIGS. 1-11. The only elements illustrated in FIG. 14 are the anterior plate 13, the cylindrical body 11, the contact support 20 and an axial terminal mounting screw 38*a*. This terminal is mounted into a casing 201 comprising a cylindrical portion 202. The cylindrical portion 202 is limited to a vertical posterior wall 204. The portion 202 has a corresponding diameter, in accordance with the current French standard, to that of a body of a male plug provided with grounding means.

The terminal structure is similar to that one described herein-above, the contact support and the secondary contacts being slightly modified so that the secondary contacts rearwardly project from the contact support 20 and directly come in contact with the contact blades 193, 193' (mounted into the cylindrical portion 202 of the casing 201) when the terminal 209 is installed into the casing 201, as illustrated in FIG. 14. The contact blades 193, 193' are connected to the pins 194, 194' destined to be inserted into the female sockets 191, 191' of the plug 190.

The purpose of the present invention is to provide for the adaptor 195 which will enable to secure same to a plug 190, in such a way that its pulling out be almost impossible and that its dismantling from the wall plug 190 be rendered difficult for uninformed individuals, e.g. children.

In accordance with the invention, this goal is attained through use of a wedge lever 198 destined to generate onto the grounding pin 192 a frictional force such that the pulling out of the adaptor 195 be almost impossible.

The lever 198 is shown as a metal part comprising at one end a wedge boring 199 of a diameter slightly larger than that of the grounding pin 192 and, at its middle, a threaded boring 200 destined to cooperate with the securing screw 38*a*.

The wedge lever 198 is mounted into the cylindrical portion 202 of the casing 201 of the adaptor 195. More particularly, the wedge lever 198 is mounted into a casing 203 provided onto the internal side of the posterior face 204 of the cylindrical portion 202. The casing 203 extends along the diameter of the plate 204 comprising a through-bore 211 for the grounding pin 192. The casing 203 is laterally limited by the ridges 205, 206 and discloses a shape substantially complementary to that of the wedge lever 198 shown in FIG. 16.

The portion 202 of casing also comprises a retaining ring 215.

The wedge lever 198 is installed onto the casing 203. A portion 216 positioned above the through-bore 199 is disposed in register with the ring 215, FIGS. 14-15. The through-bore 199 will be in register with the through-bore 211 of the wall 204, while the mounting bore 200 will be in the way of the mounting screw 38*a*.

The assembly of the terminal 209 is mounted as explained above by means of a screw 38*a* which serves the purpose applied to that of screw 38 illustrated in FIG. 1.

However, screw 38*a* is screwed into threaded bore 200.

Until the screw 38*a* is tightened, the wedge lever 198 will lay against the internal face of the wall 204. It will then be possible to introduce an adaptor into the wall plug 190 and to pull it out therefrom.

After engagement of the adaptor 195 into the plug 190, if it is desired to permanently secure this adaptor, there is only required that the screw 38*a* be tightened: by doing this, the central portion of the wedge lever 198 will raise along the screw 38*a* since the lever 198 cannot laterally pivot because of the lateral ridges 205, 206. However, the superior portion 216 cannot raise because of the retaining ring 215, see FIG. 14. A tilt of the wedge lever therefore follows, around a pivotal point corresponding to the contact point between the ring 215 and the wedge lever 198: the boring 199 will wedge the grounding pin 192 and thus a major frictional force will be generated, the more so if the screw 38*a* is tightened. It then becomes almost impossible to pull out the adaptor 195.

To remove the adaptor 195, there is only required that the screw 38*a* be unscrewed until the wedge lever comes back to a vertical position, and the pin 192 can then slide again into the boring 199.

It will be noted that the grounding pin 192 is, thanks to the lever 198, electrically connected to the screw 38*a*, the latter being connected to the pin 53 of the terminal as hereinabove described for FIG. 4.

The features of the invention described relative to FIGS. 12-16 could advantageously be used in other terminals provided with electrocution preventing means, particularly those described in the above-captioned French patent applications.

There will now be described in relation to FIGS. 17-25 another embodiment of the invention. This embodiment relates to a terminal of the same general type as the one described in relation to FIGS. 1-11 and appears as an assembly of two female plugs dimensioned to the standard which, to applicant's knowledge, are effective in the United States of America at the time of filing of the French patent application corresponding to this application.

In view thereof, the members or means having the same purpose as the already described members in FIGS. 1-11 keep their same numeral identifications, to which the letter "c" has been added to distinguish same therefrom. Certain features of these members will not be described again, being understood that the reader will be able to go back to the prior description thereof as applied to FIGS. 1-11.

Figure 17:
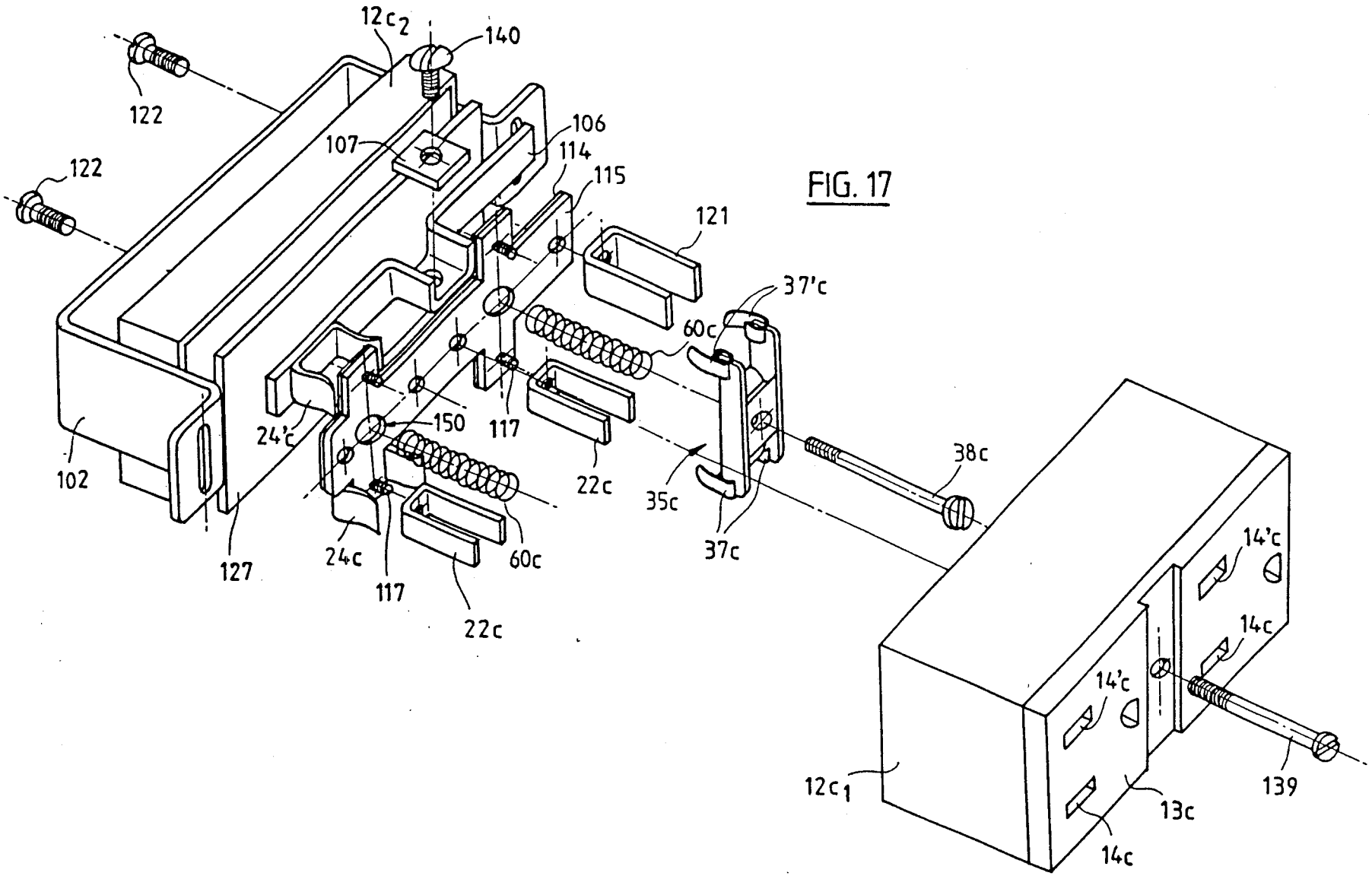
FIG. 17 is an exploded, frontward, perspective view of an alternate embodiment of the invention of an assembly of electrical energy distribution terminals in accordance with the invention.

On FIG. 17, which is an exploded view, some parts, in duplicate, have not been shown for the purpose of clarity of the drawings.

On FIGS. 17 to 25, there is shown under numeral 10*c* an assembly of two terminals 100, 101. It is to be noted that some parts are common to both terminals.

The assembly of terminals 10*c* comprise a casing 11*c* having a parallelepipedic body in two parts 12*cl*, 12*c*2. The front part 12*cl* of the body comprises an anterior wall 13*c* comprising two assemblies of two through-bores 14*c*, 14'*c* of rectangular shape for the male pins 15*c*, 15'*c* of each male plug 16*c*, dimensioned to the effective U.S. standard. The body 12*c* is carried by a clip 102 enabling securing the assembly 10*c* to a wall.

The assembly 10*c* comprises a single contact support 20*c* for the two terminals. This contact support 20*c* faces the anterior plate 13*c*. For each of the terminals 100, 101, it is adapted to carry an assembly of primary contacts 22c, 22'c faces respectively the through-bores 14c, 14'c. On the exploded view (FIG. 17), only the primary contacts 22c, 22'c have been illustrated.

Each primary contact 22c (22'c) generally appears as horseshoe shaped. This horse shoe is obtained by bending in a U a relatively thin metallic blade, of a thickness substantially equal to 1 mm. On this contact, there is defined as primary contact surfaces 25c, 26c (25'c, 26'c) the internal facing surfaces of the horseshoe. These surfaces are spaced from each other by a distance substantially smaller than the width "1" of a male pin 15c, whereas when the latter is plugged into the primary surfaces, it will become tightened, an electrical contact will then be established.

In this embodiment of invention, the first secondary contact surfaces are in the number of two by primary contact and are disposed at the back of the primary contact surfaces. For contact 22, the two first secondary contact surfaces bear numeral 27c whereas for the contact 22'c, the two secondary contact surfaces bear numeral 27'c.

Figure 21:
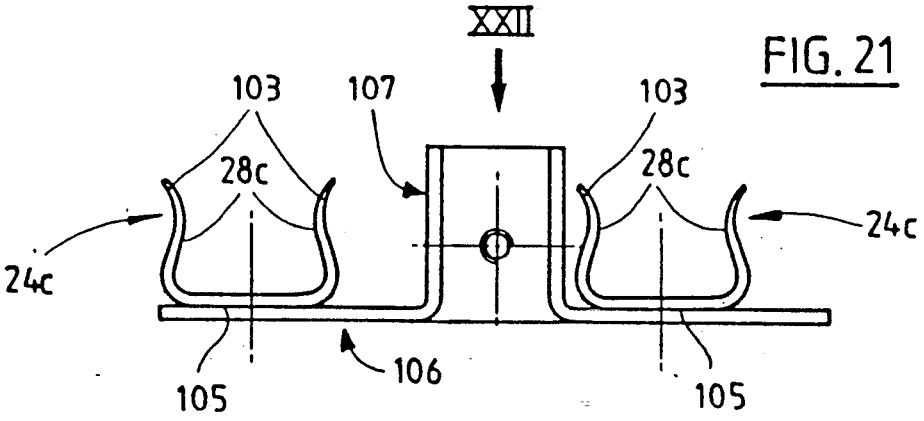
FIG. 21 is an elevational view of an assembly of secondary contacts connected by a connecting tongue used into the terminals shown in FIGS. 17 to 20.
Figure 22:
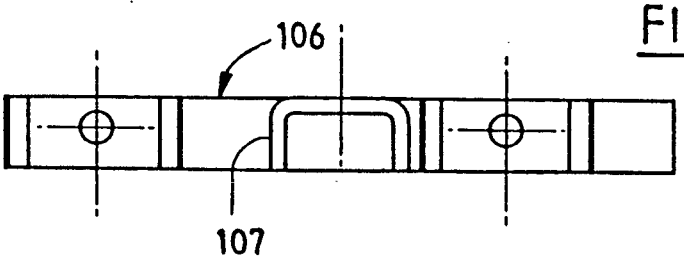
FIG. 22 is a bottom plan view along arrow XXII of FIG. 21.

The secondary contacts 24c, 24'c, are illustrated particularly in FIG. 21. They have a generally-U shape, obtained by bending in a suitable fashion a relatively thin metallic blade, of a thickness of about 0.5 mm. There is shown that the vertical legs 103 of the secondary contacts 24c, 24'c are slightly interiorly curved relative to the U, these legs thus presenting an elasticity which opposes the exterior biased displacement of the legs 103.

Each contact 24, 24' comprises second secondary contact surfaces 28c (or 28'c). These secondary contact surfaces are situated at the maximum curvature point of the vertical legs 103 of the contacts 24c or 24'c. The lower surface 105 of the base of each contact 24c or 24'c (base of the U) is connected herein thanks to a small screw (not shown on the drawings) to a connecting tongue 106 common to both terminals. This connecting tongue 106 comprises a connecting terminal 107 enabling to thus connect this assembly to an electrical wire 108 by means of a screw 140.

There will now be detailed a contact support 20c.

It appears in the shape of a generally rectangular part 115 made from an insulating material (bakelite or resin). Part 115 comprises two pairs of mounting ears 116, 116'. These ears are destined to receive the primary contacts 22c (22'c). In view thereof, each tongue comprises a mounting bore 118 and a screw head recess provided in its lower face. The contacts 22c, 22'c comprise on their base an axial threaded bore. These contacts are thus installed on the ears 116, 116' thanks to screws 117 such as illustrated in partial section on FIG. 18. The screws 117 are glued.

Another similar mounting means is envisioned for the contacts 22c, 22'c, e.g. a riveting mount.

In FIG. 18, an insulating plate 114, having the same shape as the part 115 constituting the contact support 20c, is provided to the lower face of the contact support 20c, to electrically insulate the screws 117 of the secondary contacts 24c (or 24'c).

The contact surface 20c also comprises a bore 150 for a return spring 60c associated with each of the terminals 100, 101.

The contact support also comprises a mounting bore 120 for grounding 121, made from a metallic blade bend into a U (FIG. 18). The contact 121 also comprises at its base an axial threaded bore which enables its mounting via a screw 122 (other mounting means for this ground could be envisioned by worker specialized in the field). A central threaded mounting bore is envisioned, at 122.

Each of these terminals 100, 101 comprises an insulating connecting blade 35c, interposed between the anterior wall 13c of the recess 11c and the contact support 20c. This connecting blade is mobile and may be moved along the main axis, schematized here by the symmetry axis 36c of each of the terminals 100, 101, this plate remaining parallel to itself. In view thereof, the blade 35c is, as will readily appear from the following description, guided by the primary contacts 22c, 22'c.

The connecting blade is shown in detail on FIGS. 23–25. It herein comprises a resin body 142 and two exterior wings made from bakelite 151, carrying four connecting members which, in this embodiment, are constituted from elastic metallic contacts 37c, 37'c. There is shown in FIG. 18 that these connecting members, here elastic pins 37c, 37'c, are respectively assembled to be in register each with a secondary contact space 72c, 72'c bounded respectively by the first secondary contact surfaces 27c (or 27'c) and the second secondary contact surfaces 28c (or 28'c). In view thereof, it will be noted that the contact surfaces 27c, 28c (27'c, 28'c) are spaced by a distance substantially smaller than the thickness of the elastic pins 37c, 37'c.

With respect to the primary contacts 22c, 22'c, the blade 35 comprises two cavities 40c, 40'c through which the contact legs 22c, 22'c (shown in phantom lines), carrying particularly the primary contact surfaces 25c, 26c and 25c', 26'c, respectively, may extend. These cavities 40c, 40'c for passage of the primary contacts are in register with the through-bores 14c, 14'c. In view thereof, the connecting blade 35c comprises means enabling to maintain it in such a position that the passage cavities 40c, 40'c always remain in register with the through-bores 14c, 14'c. In this embodiment, these means consist of the secondary contact surfaces 27c (or 27'c) carried by the primary contacts 22c, 22'c, onto which internal surfaces 125 of the elastic pins 37c (or 37'c) bear. Thus, the first secondary contact surfaces 27c (or 27'c) have also in this case a guiding purpose.

Under the numeral 126, there is illustrated a boring enabling the passage of the mounting screw 38c.

In the present embodiment, the presence of a support plate 127 destined to be interposed between the casing 12c and the tongue 106 bearing the contacts 24c, 24'c should be kept in mind.

The terminal 100, 101 further comprise each an elastic means, here a spring 60c destined to abut against the connecting blade 35c and onto the rear plate 127, respectively. There is shown that each of the axial bores 119 of the contact support has a sufficient diameter to allow the passage of each of the springs 60c in such a way that the latter may abut against the rear plate 127.

The assembly is assembled with the following means:

(a) the screws 38c whose head retains the connecting blade. It is envisioned that, in a commercialized, undismantleable and tamper-proof embodiment, to eliminate the screws 38c;

(b) a central screw 139;

(c) lateral screws 140 which, on the one hand will lock the contact support 20c against the parts 106 and, on the other hand, will enable the connecting of the electrical conductors 108.

There will now be described in FIGS. 23 and 25 how two important features of the present invention are included in the terminals 100, 101.

On FIG. 25, which is a top plan view of the connecting blade 35c, there is clearly shown the shape of the cavities or recesses 40c, 40'c for passage of the primary contact pins 22c, 22'c carrying more particularly the primary contact surfaces 25c, 26c and 25'c, 26'c respectively. There has in fact been shown in phantom lines the primary contact pins.

In accordance with a feature of the invention, the cavities are radially exteriorly oriented, as well as the primary contact surfaces 25c, 26c and 25'c, 26'c respectively.

There is thus shown in this embodiment as with the embodiment in FIGS. 1-11, that the cavities 40c, 40'c have a generally rectangular shape and comprise each two guiding surfaces of radial orientation associated with the two selected primary contact surfaces, here surfaces 125.

In the same way, in this embodiment, the openings 40c, 40'c are advantageously open to the outside.

The connecting blade 35c further comprises an abutment area 70c (70'c) disposed partially in register with the through-bores 14c, 14'c.

In accordance with a feature of the invention, each abutment area comprises in register with the passage associated therewith a radially exteriorly inclined surface.

In the selected embodiment, the radially exteriorly inclined surface 70c (70'c) occupies the whole of the abutment area positioned in register with the through-bores 14c, 14'c.

There is also shown, in this embodiment, that these radially exteriorly inclined surfaces are substantially arcuate and, on their lower end (bottom of FIG. 23), these inclined surfaces disclose an almost vertical orientation.

In FIG. 23, there is illustrated in full lines and in section the connecting blade 35c and in phantom lines the pins 15c, 15'c in a position which they occupy during the plugging in of the plug 16c into one of the terminals 100, 101 slightly before engagement of these pins with the inclined surface 70c, 70'c.

Generally speaking, the operation of the terminals 100 or 101 is similar to that described in relation to FIGS. 1-11.

To facilitate the understanding of the operation of the terminal, the secondary contacts 24c and the elastic pins 37c have been illustrated, in FIG. 18, in bold lines. On this figure, there has been illustrated the position of the terminal members 100 and particularly the connecting blade before plugging in of the plug 16c, schematized in phantom lines thereabove. On this same figure, the elements of the terminal 101, particularly the connecting blade 35c, are illustrated in the working position that they occupy when a plug 16c, schematized here also in phantom lines, is plugged therein.

Before introduction of a plug, the connecting insulated blade 35c is placed in a high position and is locked by the head of screw 38c. The elastic pins 37c, 37'c carries by the connecting blade 35 are in register each with a secondary contact space 72c (72'c) constituted by an assembly of contacts 27c, 28c (27'c, 28'c).

Without a male plug, it is possible to introduce through the bores 14c, 14'c metallic objects (such as holes or even small lamellae having the same dimensional features as a pin 15c). In such a hypothesis, these metallic objects would extend through the bores 14c, 14'c, would deviate because of the inclined surface 70c (70'c) and would engage into the primary contact surface 25c, 26c (or 25'c, 26'c as the case may be). The connecting blade will not be pushed back against the spring 60c and the elastic pins 37c, 37'c will not come in contact with the secondary contacts 27c, 28c and 27'c, 28'c respectively: current will not pass.

When a male plug 16c is plugged in and when pins 15c, 15'c of the latter are engaged into the through-bores 14c, 14'c, after a while, these pins reach the primary contact surfaces 25c, 26c and 25'c, 26'c respectively. They then engage into the primary contact space provided respectively between these primary contact surfaces. From that time, there is thus electrical connected between the pins 15c (15'c) and the primary contact surfaces 25c, 26c (25'c, 26'c). The connecting blade will still not however be pushed back or, at the very least, be slightly pushed back, and the current still does not pass through.

It is not until the male pins 15c, 15'c abut against the abutment areas 70, 70'c included into the connecting blade 35c, that the latter will be pushed back into a working position where it is illustrated to the right of the FIG. 18 (terminal 101): each secondary pin 37c (37'c) thus establishes a contact between the secondary surfaces 27c, 28c (27'c, 28'c) with which it is associated. The current will then pass through, from the contact terminal 107 to the secondary contact 24c (or 24'c), then to the elastic contact 37c or 37'c), thereafter to the first secondary contact surface 27c (or 27'c), then to the primary contact surfaces 25c, 26c (or 25'c, 26'c), and finally, into the selected male pins 15c (15'c).

The assembly of terminals 10c herein described provides a good electrocution-preventing protective, thanks to the inclined abutment surfaces 70c, 70'c of the connecting blade 35c, particularly for the hereinabove reasons with respect to FIGS. 1-11.

Indeed, as with the terminal based on the French standards in these figures, if one introduces a nail or even a blade having substantially the same dimensions as the pin 15c, and even if one does not maintain this blade firmly parallel to the axis 36c, this blade will scrape against the abutment surface 70c and will naturally come to be radially exteriorly released. To enable the displacement of the connecting blade 35c against the spring 60c, one has to apply a particularly important axial force the more so if one takes into account the fact that by thus engaging a free blade into the terminal, the grip that one has on the latter is not precise and in general not firm: unless a voluntary and thoughtful action is made to apply the required axial force, this blade will scrape against the inclined abutment surface 70c.

In practice, it will be only when one engages the pins 15c, 15'c belonging to a plug 16c having the required spacing, into the through-bores 14c, 14'c that one is able to displace the connecting blade 35c toward its working position. In view thereof, the above-noted explanations for FIGS. 8 and 10 are still applicable here.

It will be observed that in the present embodiment, there is a spark preventing safety means.

Indeed, the shape and dimensions of the various contact surfaces and those of the connecting elements are such that during the disconnection of the male plug, the male pins are disengaged from the primary contact surfaces before the connecting elements are disengaged from the assemblies of secondary contact surfaces.

Thus, in FIG. 18, there is shown that the run "x" of the elastic pins 37c, 37'c along the secondary contacts 24c, 24'c is greater than the run "y" of the pins 15c, 15'c along the primary contacts 22c, 22'c.

Figure 26:
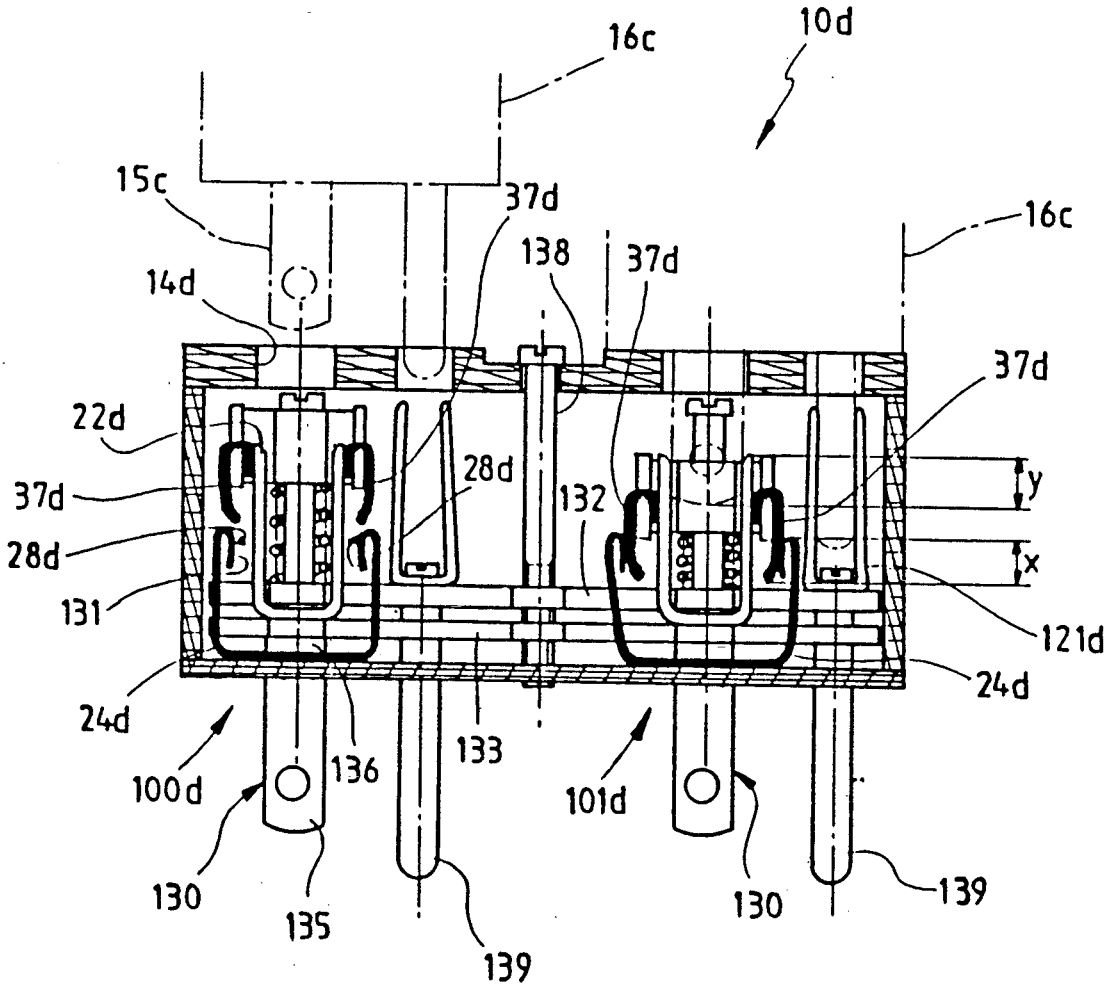
FIG. 26 is a view similar to that of FIG. 18, but for another embodiment of electrical energy distribution terminal assembly in accordance with the teachings of the invention, in the shape of an adaptor.
Figure 27:
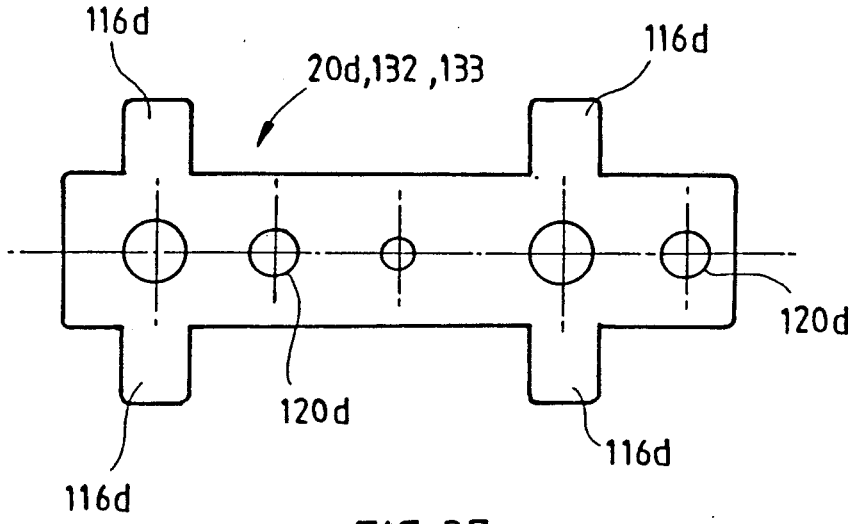
FIG. 27 is a top plan view of the contact support used in these terminals.
Figure 28:
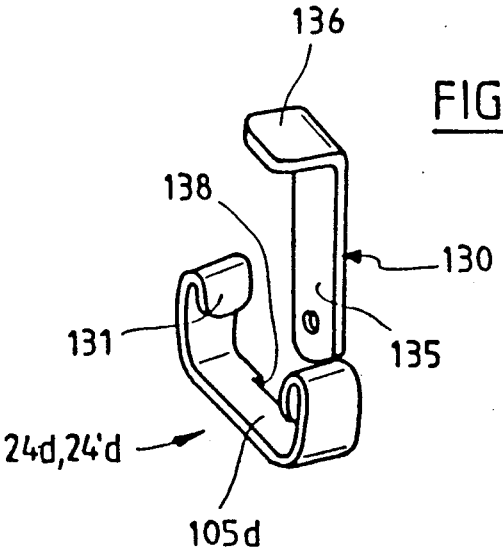
FIG. 28 is a view of a connecting pin/secondary contact assembly used in the terminals of FIG. 26.

There will now be detailed with respect to FIGS. 26–28 an alternate assembly of terminals relative to the above-described one. This alternate embodiment relates to an adaptor i.e. a terminal destined to be connected to a wall plug not provided with electrocution-preventing means.

In this embodiment, most of the means are similar to those which have just been described with respect to FIGS. 17–25. For this description, the means having the same purpose as the already described elements for FIGS. 17–25 retain their same numeral, the letter "d" having been substituted to the letter "c" or added for distinguishing purposes. These elements will not be described again in detail. If required, it is always possible for the reader to come back to the herein-above noted description.

In this embodiment, the sole elements that are different from the ones in the above-noted embodiment, are the following:

the contact support 20*d* (FIG. 27);

the secondary contacts 24*d* (FIG. 28).

Moreover, it is to be noted that there is no connecting members between the secondary contacts such as the connecting strip 106. Indeed, the secondary contacts are directly connected to pins 130 (130') destined to be introduced in the wall plug.

The secondary contacts 24*d*, 24'*d* also disclose a generally U-shape. However, the vertical contact legs are extended by second downwardly bent, vertical legs, bearing numeral 131. The second vertical legs 131 are slightly interiorly inclined, thus constituting an elastic means opposing the exteriorly offsetting bias of the assembly of vertical legs.

The secondary contact surfaces 28*d* (or 28'*d*) are disposed on the surface of the legs 131 interiorly facing the contact 24*d* or 24'*d*.

Figure 20:
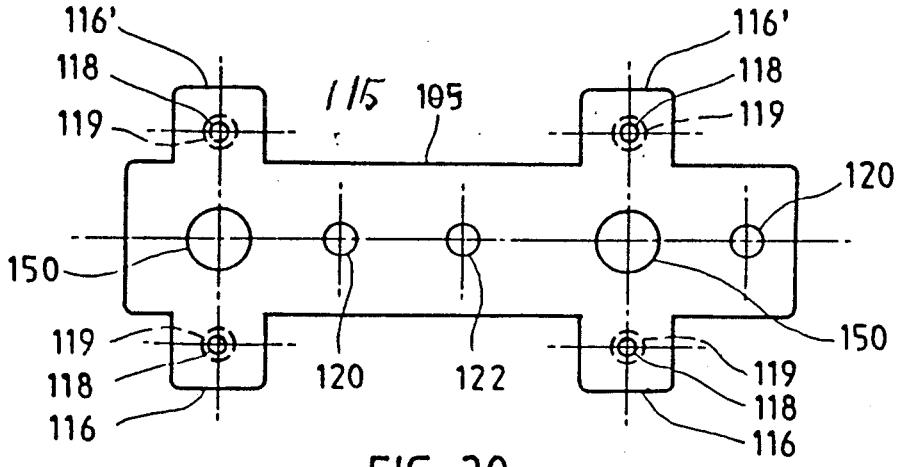
FIG. 20 is a plan view of a contact support used in the terminals shown in FIGS. 17 to 19.

The contact surface 20*d* has a shape substantially similar to that one described in FIG. 20. It is to be noted however that it is made in two identical parts 132, 133, the primary contacts 22*d*, 22'*d* being taken in sandwich between the ears 116*d* from each of these parts. These contacts may also be further covered entirely by resin.

Each pin 130 (130') comprises, on the one hand, a connecting leg 135 (135') and, on the other hand, a contact leg 136 (136') constituting a single and same part with a connecting leg and bound to the latter by a right-angle elbow.

Each connecting leg 135 (135') is taken in sandwich between the lower part 133 of the contact support 20*d* and the base 105*d* of a secondary contact 24*d* (24'*d*), the base 105 of each contact 24*d* bearing against the lower face of the casing 12*d*.

It will be noted that, on the basis of each secondary contact 24*d* (24'*d*), there is a notch 138 (FIG. 27) enabling the positioning of the connecting leg 135 of the associated pin 130, in such a way that the leg 135 will extend substantially along a vertical axis of symmetry of the contact 24*d*, along the extension of the associated through-bore 14*d*.

There is contact between the contact base 105 and the contact leg 136 of each pin 130 (130').

A grounding pin 139 is screwed to the ground contact 121*d*.

The assembly is assembled through a mounting screw 138 specifically enabling the binding of parts 132, 133 to the casing 12*d* wherein the parts to be taken in sandwich are firmly secured.

The operation of the assembly of terminals shown on this figure is similar to that which has been described in relation to FIGS. 17 to 25. There is shown that the current passes directly from the pins 130, 130', plugged into the wall plug, to the selected secondary contact 24*d* (24'*d*), then, through the elastic connecting elements 37*d* (37'*d*), to the primary contact 22*d* (22'*d*) and to the pins 15*c* (15'*c*) of the plugs 16*c*.

The electrocution preventing safety means operates as described hereinabove, particularly in relation to FIGS. 8–10 and 23.

It is possible to provide staple means similar to those described in FIGS. 12 and 13.

Of course, the present invention is not limited to the selected embodiments and it extends to any alternate embodiment within the reach of a person skilled in the art.

For example, even if the embodiments herein-disclosed relate to single-phase terminals, the person skilled in the art will easily apply the present invention to triple-phase terminals and the like.

It is also to be noted that, with respect to the embodiments that will be manufactured and put on the market, the terminals will become tamper-proof particularly by ultrasonic welding, particularly for the casing.

I claim:

1. Female terminal for electrical current distribution, comprising at least one assembly of at least two female sockets destined to receive as many male parallel pins belonging to a male electrical plug having a predetermined spacing, said female sockets extending parallel to a main axis, the terminal further comprising:

(a) a casing made from an insulating material comprising an anterior mounting plate having at least two through-bores for the male pins;

(b) a contact support facing the anterior wall, adapted to carry:

(i) at least two primary contacts destined to receive said male pins, each of these primary contacts comprising in view thereof two primary contact surfaces mounted in respective register, extending along the pathway of the male pin so as to tightingly enclose the latter, these surfaces being connected to a first secondary contact surface;

(ii) at least two secondary contacts, each having, on the one hand, at east a second secondary contact surface and, on the other hand, electrical connecting means at a current outlet, each second secondary contact surface being assembled to be in register with one of said first secondary surfaces of primary contacts and to thus define an assembly of secondary contact surfaces;

(c) an insulating connecting blade, positioned between the cavity anterior wall and the contact support, destined to move along said axis while remaining parallel to itself, this blade comprising at least two connecting members each destined to come in simultaneous contact with the two contact surfaces of an assembly of secondary contact surfaces when the blade is in a "working" position, the blade further comprising, in register with the primary contact surfaces of each of the primary contacts, a cavity destined to enable the passage of said primary contact surfaces of the assembly of primary contacts which are in register with the cavity and at least two abutment areas mounted partially in register with said through-bores;

(d) elastic means adapted to maintain said blade spaced from its working position until an assembly of male pins is engaged into said sockets;

wherein said blade cavities are radially exteriorly oriented, as well as the primary contact surfaces, whereas each abutment area comprises, in register with the associated through-bore, a radially-exteriorly inclined surface.

2. A terminal as defined in claim 1, wherein said connecting blade comprises at least two axial guiding surfaces adjacent to said inclined surfaces and frontwardly thereof.

3. A terminal as defined in claim 2, wherein the connecting blade further comprises, frontwardly of the guiding surfaces, at least two second inclined surfaces.

4. A terminal as defined in claim 1, wherein said first inclined surface is arcuate.

5. A terminal as defined in claim 1, further including staple means destined to fixedly secure the terminal to a wall plug.

6. A terminal as defined in claim 1, wherein it is destined to be connected to a terminal, particularly a wall plug, comprising a projecting grounding pin, and wherein it comprises securing means adapted to generate a major frictional force onto the grounding pin.

7. A terminal as defined in claim 6, wherein said frictional means comprise a wedge lever having a through-bore for the grounding pin and means adapted to enable the tilt of the lever in such a way that the grounding pin will become stuck into the through-bore for this pin contained by the wedge ever.

8. A terminal as defined in claim 1, wherein said contact surfaces and said connecting members are respectively conformed in such a way that when said male plug is disconnected, said male pins are disengaged from the primary contact surfaces before said connecting members are disengaged from the assembly of secondary contact surfaces.

* * * * *